US006536870B1

(12) United States Patent
Takahashi et al.

(10) Patent No.: US 6,536,870 B1
(45) Date of Patent: Mar. 25, 2003

(54) INK JET RECORDING CARTRIDGE, METHOD FOR MANUFACTURING INK JET RECORDING CARTRIDGE, APPARATUS FOR MANUFACTURING INK JET RECORDING CARTRIDGE, AND RECORDING APPARATUS

(75) Inventors: Wataru Takahashi, Kawasaki (JP); Masafumi Takimoto, Tokyo (JP); Ken Hosaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,003

(22) Filed: Oct. 25, 1999

(30) Foreign Application Priority Data

Oct. 27, 1998 (JP) ..... 10-306143
Feb. 10, 1999 (JP) ..... 11-033266

(51) Int. Cl.[7] ..... B41J 2/175
(52) U.S. Cl. ..... 347/49; 347/87
(58) Field of Search ..... 347/49, 87

(56) References Cited

U.S. PATENT DOCUMENTS 4,712,172 A * 12/1987 Kiyohara et al. ..... 347/87 X
4,755,836 A * 7/1988 Ta et al. ..... 347/49
5,359,357 A 10/1994 Takagi et al. ..... 347/49
5,821,961 A 10/1998 Sato ..... 347/63

FOREIGN PATENT DOCUMENTS

| | | |
|---|---|---|
| EP | 0 516 088 | 5/1992 |
| EP | 0 622 234 | 4/1994 |
| JP | 60-204342 | 10/1985 |
| JP | 9-239971 | 9/1997 |

* cited by examiner

*Primary Examiner*—Huan Tran
(74) *Attorney, Agent, or Firm*—Fitzpatrick, Cella, Harper & Scinto

(57) ABSTRACT

An ink jet recording cartridge mounted on a movable carriage comprises an ink jet recording head for recording by discharging ink from the discharge ports to a recording medium, and a housing for holding the ink jet recording head. For the housing of this cartridge, extrusions are arranged to abut upon the grooved portions arranged for the carriage, and the extrusions are made capable of adjusting the relative positions of the ink jet recording cartridge and the carriage. With the ink jet recording cartridge thus structured, it becomes possible to position the discharge ports of the recording head easily and exactly corresponding to the predetermined position in the carriage. Even if the precision varies when the recording head is installed on the housing of the cartridge, the extrusions are arranged to shift in accordance with such variation to serve the purpose.

20 Claims, 30 Drawing Sheets

FIG. 22

<PROCESSING AMOUNT INDEX>

θ TABLE

| α [°] | UX1 [μm] | MX1 [s] | X | Y |
|---|---|---|---|---|
| 15 | 60 | 0.06 | −15 | 35 |
| 10 | 40 | 0.04 | −10 | 20 |
| 5 | 20 | 0.02 | −5 | 10 |
| 0 | 0 | 0 | 0 | 0 |

TRANSLATIONAL TABLE

| UX1 [μm] | MX1 [s] | X | Y |
|---|---|---|---|
| 300 | 0.3 | 60 | 0 |
| 150 | 0.15 | 30 | 0 |
| 100 | 0.1 | 15 | 0 |
| 0 | 0 | 0 | 0 |

| UX2 [μm] | MX2 [s] | X | Y |
|---|---|---|---|
| 300 | 0.3 | 60 | 0 |
| 150 | 0.15 | 30 | 0 |
| 100 | 0.1 | 15 | 0 |
| 0 | 0 | 0 | 0 |

| UY [μm] | MY [s] | X | Y |
|---|---|---|---|
| 200 | 0.4 | 0 | 60 |
| 100 | 0.2 | 0 | 40 |
| 50 | 0.1 | 0 | 20 |
| 0 | 0 | 0 | 0 |

<PREDETERMINED POSITION INDEX>

| | X | Y |
|---|---|---|
| FIRST DISCHARGE PORT | 700 | 300 |
| 160th DISCHARGE PORT | 400 | 350 |

FIG. 31

<ROTATION AMOUNT INDEX>

θ TABLE

| α [°] | X1 [°] | X | Y |
|---|---|---|---|
| −15 | −30 | −15 | 30 |
| −10 | −20 | −10 | 20 |
| −5 | −10 | −5 | 10 |
| 0 | 0 | 0 | 0 |
| 5 | 10 | 5 | −10 |
| 10 | 20 | 10 | −20 |
| 15 | 30 | 15 | −30 |

TRANSLATIONAL TABLE

| X1 [°] | X2 [°] | X | Y |
|---|---|---|---|
| −40 | 40 | 60 | 0 |
| −20 | 20 | 30 | 0 |
| −10 | 10 | 15 | 0 |
| 0 | 0 | 0 | 0 |
| 10 | −10 | −15 | 0 |
| 20 | −20 | −30 | 0 |
| 40 | −40 | −45 | 0 |

| Y [°] | X | Y |
|---|---|---|
| −45 | 0 | 60 |
| −30 | 0 | 40 |
| −15 | 0 | 20 |
| 0 | 0 | 0 |
| 15 | 0 | −20 |
| 30 | 0 | −40 |
| 45 | 0 | −60 |

<PREDETERMINED POSITION INDEX>

| | X | Y |
|---|---|---|
| FIRST DISCHARGE PORT | 700 | 300 |
| 160TH DISCHARGE PORT | 400 | 350 |

INK JET RECORDING CARTRIDGE, METHOD FOR MANUFACTURING INK JET RECORDING CARTRIDGE, APPARATUS FOR MANUFACTURING INK JET RECORDING CARTRIDGE, AND RECORDING APPARATUS

BACKGROUND OF THE INVENTION

1. Field of the Invention

The present invention relates to an ink jet recording cartridge provided with an ink jet recording that performs recording on a recording medium by discharging ink from the discharge ports, a method for manufacturing an ink jet recording cartridge, and an apparatus for manufacturing an ink jet recording cartridge. The invention also relates to a recording apparatus.

The present invention is applicable to a printer that records on papers, threads, textiles, cloths, leathers, metals, plastics, glass, woods, ceramics, and other recording media, a copying machine, a facsimile equipment provided with communication system, a word processor or some other apparatuses provided with the printing unit therefor. The invention is also applicable to an industrial printing system complexly structured in combination with various processing apparatuses. Here, in the specification of the present invention, the term "record" means not only the provision of characters, graphics, and other meaningful images, but also, it means the provision of patterns or other images which do not present any particular meaning when recorded on a recording medium.

2. Related Background Art

For the conventional ink jet recording apparatus, there have been used an ink jet recording head that performs recording on a recording medium by discharging ink form the discharge ports, and an ink jet recording cartridge which is formed integrally with an ink tank containing ink to be supplied to the ink jet recording head or which is structured to use the recording head and the ink tank individually. For the ink jet recording apparatus, a carriage is provided to reciprocate in the direction almost orthogonal to the carrying direction of a recording medium. The ink jet recording cartridge is mounted on this carriage.

As the ink jet recording head, there has been known the one that discharges ultra fine liquid droplets by the utilization of thermal energy generated by use of electrothermal transducing devices or the like or the one that discharges liquid droplets by the deflection of each pair of electrodes provided therefor. Of these heads, the ink jet recording head that discharges ink liquid droplets by the utilization of thermal energy makes it possible to record in higher resolution, because the liquid discharge portion (discharge ports) can be arranged in high density for the formation of flying liquid droplets by discharging liquid droplets for use of recording. As a result, among other advantages, an apparatus of the kind has an advantage that not only recording is possible in higher resolution, but also, the apparatus can be made compact with ease. This type of the apparatus has already been in wide use practically.

The ink jet recording head that discharges recording liquid by the utilization of thermal energy is provided with discharge ports (orifices) through which liquid is discharged; liquid flow paths communicated with the discharge ports; and a plurality of discharge energy generating members, such as electrothermal transducing devices, which are arranged for the liquid flow paths, respectively. Then, the structure is arranged so that print recording is made with the provision of discharge energy (thermal energy for creating film boiling in liquid, for example) by the application of driving signals to the discharge energy generating members in accordance with the recording information, which enables liquid to be discharged from the discharge ports as liquid droplets.

Here, with reference to FIG. 33, the description will be made of the general structure of the ink jet recording head described above.

The ceiling plate 1100 that constitutes the ink jet recording head H is formed by resin material by molding integrally with a ceiling plate member that forms a liquid chamber 1104 and a plurality of liquid flow paths 1103 to retain liquid; a discharge port formation member 1101 that forms a plurality of discharge ports (orifices) 1102 each communicated with the plural liquid flow paths 1103, respectively; and a recording liquid supply port 1105. Also, for the heater board (elemental substrate) 1107, the heaters (electrothermal transducing devices) 1106 which are arranged in plural lines on a silicon substrate, and the electric wires (not shown) made of aluminum or the like to supply electric power to the heaters are formed by the known film forming technologies and techniques. These are positioned and fixed on the base plate 1110 by the application of the known die bonding techniques. The wiring substrate 1108 is provided with the wiring lines connected with the wiring of the heater board 1107 by use of the known wire bonding, and a plurality of pads 1109 which are positioned at each end portion of the wiring lines to receive electric signals from the apparatus main body. Then, the ceiling plate 1100 and the heater board 1107 are positioned and connected corresponding to each of the liquid flow paths 1103 and heaters 1106, which are fixed on the base plate 1110 together with the wiring substrate 1108, hence forming the ink jet recording head H.

The ink jet recording apparatus that uses the ink jet recording head described above is mainly connected with a word processor or a personal computer, and used as a color printer. Besides, it is used as the engine for a facsimile equipment or a copying machine.

FIG. 34 is a perspective view which shows the conventional ink jet recording cartridge. As shown in FIG. 34, the ink jet recording head H is mounted in the predetermined position of the ink jet recording cartridge main body 1130. Then, adjacent to the ink jet recording head H, the sub-tank 1120 is arranged for use of recording liquid. The sub-tank 1120 and the ink jet recording head H are supported by the supporting members 1121 and 1122. Further, in the interior of the ink jet recording cartridge main body 1130 covered by the covering member 1131, a recording liquid tank (not shown) is incorporated. With the structure thus arranged, recording liquid is supplied from this tank to the sub-tank 1120 appropriately.

For the ink jet recording head, there is the one having plural colors of ink (four colors, black:Bk, yellow:Y, magenta:M, and cyan:C, for example) each allocated to the divided ink discharge unit in one head, which is a type that although the number of discharge ports per color is small, the costs of manufacture is low. There is also the one having a plurality of ink jet recording cartridges arranged in line with each of the separated recording heads individually arranged per color, although the costs of manufacture is high, which is a type that the number of discharge ports can be increased per color. There is still the one presenting a combined head type in which a plurality of individual ink discharge units are incorporated on one base per color. Here, it is unstable to apply the one head type mode to a higher printing as a matter of course.

In order to enhance the print quality, there is a type in which the plural ink jet recording cartridges are arranged side by side so as to provide the recording heads individually for each color. Then, in some cases, each of the cartridges may be provided with a medium to store the recorded properties of its own or correction data for it. Also, for a type of the combination heads, the positional deviation of ink droplets themselves is measured in advance for those to be discharged from the discharge ports of each color arranged for the orifice plate. Then, the arrangement is made so as to correct the amount of such deviation when assembling each of the recording heads on the base in good precision. Further, the combined head type is such that the plural recording heads are formed on the base integrally. As a result, not only the deviation between each of printed colors is smaller, but also, it is easier to execute the head replacements.

FIG. 35 is a perspective view which shows the assembled body of the conventional ink jet recording head disclosed in the specification of Japanese Patent Application Laid-Open No. 9-239971.

As shown in FIG. 35, the assembled body of the conventional ink jet recording head comprises the base 1301 on which a plurality of ink discharge units are formed with ink discharge ports formed therefor; and the printed board 1302 having the ROM 1304 incorporated thereon to record and store the positional data defined per ink discharge unit in accordance with the actually measured data on the positional deviation between each of ink droplets to be discharged from the plural discharge ports, and the data on the properties of each ink discharge unit or the data needed for the correction of such properties. For the assembled body of the ink jet recording head, the ink supply ports 1303 are also provided to receive ink to be supplied from the ink tank or the like (which is not shown). For the printed board 1302, contact electrodes 1305 are arranged, and the control unit of the recording apparatus main body is connected with the assembled body of the ink jet recording head through these contact electrodes 1305.

When the printing operation is executed, the control unit of the recording apparatus main body performs the correction process of the pulse emit timing or the pulse width of the driving signal, which drives each of the energy generating members to discharge ink, in accordance with the data thus stored. Therefore, the conventionally assembled body of the ink jet recording head thus structured is able to prevent defective prints due to the print deviation or the like, hence making the color printing possible.

Further, in recent years, with the increased needs for the full color recording in higher quality at higher speeds, there is more demand on the further enhancement of the printing speeds, resolutions, and gradations. In order to make the photographic image quality possible, there has been proposed the implementation of a higher gradation by use of the ink tank arranged for six colors or seven colors by changing the density of each color, not to mention the use of the aforesaid four color ink, such as Y, M, C, and Bk. For the implementation of the higher speed and higher quality ink jet recording apparatus, it is desirable to use a type in which a plurality of ink jet recording head cartridges are provided, a type in which heads are combined, or a type in which these types are combined. Further, in order to implement the higher quality color images without having color unevenness or print deviations, there is a need for the exact placement of impact positions of ink droplets themselves which are discharged from each of the recording heads. To this end, the discharge ports of each recording head should be arranged exactly in the predetermined positions.

Now, therefore, it is known to provide an abutting portion for the ink jet recording cartridge in relation to the carriage in order to mount the ink jet recording cartridge exactly in the predetermined position of the carriage.

However, it is generally practiced that a head chip (head unit) is assembled in a molded housing to constitute an ink jet recording cartridge. For the ink jet recording cartridge thus structured, there is a fear that the assembling precision tends to vary when the head chip is installed on the housing. As a result, even if a structure is arranged so that the abutting portion provided for the ink jet recording cartridge is in contact with the carriage for the enhancement of the installation accuracy of the cartridge on the carriage, there is still a fear that the position and direction of the discharge port arrays tend to vary per each individual product. When a plurality of head cartridges are mounted on one carriage in particular, it is required to position the discharge port arrays of the recording heads themselves per head cartridge.

Also, for the ink jet recording cartridge of the combined head type described above, it is required to assemble each of the color ink discharge units on the orifice plate in precision higher still. Furthermore, it is required to minimize the positional deviation when the orifice plate is bonded to the base member. As a result, there is a need for the apparatus for manufacturing the ink jet recording head cartridge to provide a higher precision, which makes the costs of manufacturing apparatus higher still as a matter of course. Also, there is a need for more rigid tolerance of precision of each part that forms the recording cartridge. There is a problem encountered that the costs of the required parts become higher inevitably.

Also, for the recording cartridge of the type having the various properties of its own or having the correction data, there is a tendency that difference may take place in the installation positions when the recording cartridge is installed on an inspection equipment and on a carriage actually due to the deformation of the recording cartridge itself, the defective performance of abutting to the carriage, or the like. This inevitably brings about the deviation in the relative positions of each of the color recording cartridges themselves with the resultant deviation in prints themselves between the recorded images in each of the colors. Also, when the replacement of recording cartridges is required or in the similar case, the user of the ink jet recording apparatus should operate the adjustment of the print deviations, which becomes a heavy burden on the user side.

Further, for the combined head type which also has the various properties of its own cartridge or the correction data, there is a need for the process to obtain the required data by executing the off-line printing tests, as well as for the adjustment process on the basis of the data thus obtained. As a result, the manufacture steps of the recording head cartridge becomes complicated, leading to the reduction of the productivity. Also, there is a need for the provision of hardware and software sources (such as memories) required for the correction of the positional deviations. The costs of the ink jet recording apparatus itself becomes inevitably higher. In addition, for the inspection of the positional deviations (print deviations), extra ink and recording medium are needed, which presents unfavorable problems from the economical and ecological viewpoints.

SUMMARY OF THE INVENTION

With a view to solving the problems discussed above, the present invention is designed. It is an object of the invention to provide an ink jet recording cartridge capable of adjusting the position and direction of the discharge port array of a recording head easily and exactly corresponding to the predetermined standard position, a method for manufacturing an ink jet recording cartridge, and an apparatus for manufacturing an ink jet recording cartridge, as well as to provide a recording apparatus.

It is another object of the invention to provide an inexpensive ink jet recording cartridge but capable of presenting high quality images without any complicated adjustment mechanism and adjustment process needed for correcting the deviation in prints, a method for manufacturing an ink jet recording cartridge, and an apparatus for manufacturing an ink jet recording cartridge, as well as to provide a recording apparatus.

It is still another object of the invention to provide an ink jet recording cartridge to be mounted on a movable carriage, comprising an ink jet recording head for recording by discharging ink from the discharge ports to a recording medium, and a housing for holding the ink jet recording head. For the housing of this cartridge, extrusions are arranged to abut upon the grooved portions arranged for the carriage, and the extrusions are capable of adjusting the relative positions of the ink jet recording cartridge and the carriage.

With the ink jet recording cartridge of the invention of the kind, it becomes possible to position the discharge ports of the recording head easily and exactly corresponding to the predetermined position in the carriage, because even if the precision varies when the recording head is installed on the housing of the cartridge, the extrusions are structured to shift in accordance with such variation.

Also, the portions of the extrusions that abut upon the grooves may be structured so as to be retracted in the direction opposite to the abutting direction of the ink jet recording cartridge toward the carriage.

Further, the structure may be arranged so that the extrusions are formed integrally with the housing to reduce the number of parts of the ink jet recording cartridge.

Further, the extrusions may be formed by resin material.

Also, the extrusions may be structured with cam members rotatively fixed to the housing. With this arrangement, it becomes possible to readjust the retracting width of the extrusions.

Also, the extrusions may be provided for the side face of the housing, which is substantially perpendicular to the direction of the reciprocal traveling of the carriage.

Further, the housing is provided with the two side faces, and on one of them, an extrusion is arranged, and on the other side face, two of them are arranged. With the structure thus arranged, it becomes possible to position the ink jet recording cartridge in the vertical and horizontal direction, as well as to adjust the angle with respect to the carriage.

Also, among the ridge portions of the housing, the ridge portion, which abuts upon the carriage when mounted on the carriage, is formed to be spherical to make it possible to mount the ink jet recording cartridge on the carriage smoothly.

Further, the structure is formed so that the contact surface is arranged for the housing with contact pads which are connected with the contact points provided for the carriage, and both on the ends below such contact surface, the substantially triangular extrusions are arranged, respectively. Thus, when the ink jet recording cartridge is mounted on the carriage, it is possible to prevent the recording head from being in contact with the contact pads to stain them or to damage the recording head itself.

Further, it is preferable to arrange the structure so that a rib type extrusion is provided for the portion of the housing between the substantially triangular extrusions themselves.

Further, the structure may be formed so that above the contact surface on the surface of the housing where the contact surface is arranged, the extrusion that exert pressure on the housing to be pressed to the carriage.

Also, the carriage is provided with a push-out member to push out the ink jet recording cartridge out of the carriage by pressing the ink jet recording cartridge when removing the ink jet recording cartridge mounted on the carriage, and on the portion of the housing pressed by the push-out member, the inclined surface is formed for the push-out member to slide thereon. With the structure thus arranged, it becomes possible to smoothly operate the removal of the ink jet recording cartridge from the carriage.

Further, in order to arrange the discharge ports for the predetermined position in the carriage, it is preferable to arrange the structure so that the abutting portions of the extrusions against the grooves are retracted by a specific distance in the direction opposite to the abutting direction of the ink jet recording cartridge toward the carriage.

It is a further object of the invention to provide an ink jet recording cartridge to be mounted on a movable carriage, comprising an ink jet recording head for recording by discharging ink from the discharge ports to a recording medium, and a housing for holding the ink jet recording head. For this cartridge, the housing is provided with adjusting means which abuts upon the carriage for arranging the discharge ports of the ink jet recording cartridge for the predetermined position in the carriage when the ink jet recording cartridge is mounted on the carriage.

With the ink jet recording cartridge of the invention of the kind, it becomes possible to position the discharge ports of the recording head easily and exactly corresponding to the predetermined position in the carriage, because even if the precision varies when the recording head is installed on the housing of the cartridge, the adjusting means is structured to make the required adjustment in accordance with such variation. Further, it may be structured to arrange the adjusting means to be rotatively fixed to the housing, and the contact portion with the carriage is then structured with an abutting pin eccentric to the rotational axis.

In addition, the ink jet recording head may be formed to be provided with electrothermal transducing members for generating thermal energy for use of ink discharges.

Further, it maybe possible to arrange the structure so that the ink jet recording head discharges ink from the discharge ports by utilization of film boiling created in ink by thermal energy applied by the electrothermal transducing members.

Also, in accordance with the present invention, a method for manufacturing an ink jet recording cartridge, which is provided with an ink jet recording head for recording on a recording medium by discharging ink from the discharge ports, and a housing for holding the ink jet recording head, which is provided with the extrusions that abut upon the grooved portions arranged for the movable carriage, comprises the step of adjusting the relative positions of the ink jet recording cartridge and the carriage in order to arrange the discharge ports for the predetermined position in the carriage by shifting the positions of the extrusions in the housing.

With this method, it becomes possible to manufacture an ink jet recording cartridge capable of positioning the discharge ports of the recording head easily and exactly corresponding to the predetermined position in the carriage even if the precision varies when the recording head is installed on the cartridge.

Further, it may be possible to arrange the method so that the step of adjusting the relative positions of the ink jet recording cartridge and the carriage by shifting the positions of the extrusions in the housing is to be a step of retracting the abutting portions of the extrusions against the grooves in a specific distance in the direction opposite to the abutting direction of the ink jet recording cartridge toward the carriage.

Further, it may be possible to arrange the method so that the step of retracting the abutting portions of the extrusions against the grooves in a specific distance in the direction opposite to the abutting direction of sad ink jet recording cartridge toward the carriage comprises the steps of fixing the ink jet recording cartridge in the same condition as being mounted on the carriage; recognizing the positions of the discharge ports of the fixed ink jet recording cartridge; calculating the specific distance in accordance with the difference between the predetermined positions in the carriage and the recognized positions of the discharge ports; and retracting the portions of the extrusions abutting against the grooves in the calculated amount of the specific distance in the direction.

Further, it may be possible to arrange the method so that the extrusions are formed by resin material, and the step of retracting in a specific distance the portions of the extrusions abutting against the grooves in the direction opposite to the abutting direction of the ink jet recording cartridge against the carriage is the step of retracting the portions in the specific distance in the direction by fusing the portions with ultrasonic oscillators in contact under pressure with the abutting portions of the extrusions against the grooves, or the extrusions are structured with the cam members rotatively fixed to the housing, and the step of retracting in a specific distance the portions of the extrusions abutting against the grooves in the direction opposite to the abutting direction of the ink jet recording cartridge against the carriage is the step of retracting by rotating the cam members the abutting portions of the cam members against the grooves in the specific distance in the direction. With the method thus arranged, it becomes possible to manufacture an ink jet recording cartridge capable of readjusting the retracting width of the extrusions.

Also, in accordance with the present invention, a method for manufacturing an ink jet recording cartridge, which is provided with an ink jet recording head for recording on a recording medium by discharging ink from the discharge ports, and a housing for holding the ink jet recording head, which is provided with adjusting means that abut upon the carriage when the ink jet recording cartridge is mounted on the carriage, in order to arrange the discharge ports of the ink jet recording cartridge for the predetermined position in the carriage, and also, the adjusting means which is structured with the abutting pins rotatively fixed to the housing, and the contact sections with the carriage which is made eccentric to the rotational shafts, is arranged to comprise the step of fixing the ink jet recording cartridge in the same condition as being mounted on the carriage; recognizing the positions of the discharge ports of the fixed ink jet recording cartridge; calculating the rotational amounts of the eccentric pins in accordance with the difference between the predetermined positions in the carriage and the recognized positions of the discharge ports; and rotating the eccentric pins only by the calculated rotational amounts.

With this method, it becomes possible to manufacture an ink jet recording cartridge capable of positioning the discharge ports of the recording head easily and exactly corresponding to the predetermined position in the carriage even if the precision varies when the recording head is installed on the cartridge.

In addition, the ink jet recording cartridge of the present invention may be the one manufactured by the method described above.

Also, the apparatus of the present invention for manufacturing an ink jet recording cartridge, which is provided with an ink jet recording head for recording on a recording medium by discharge ink from the discharge ports, and a housing for holding the ink jet recording head, which is provided with extrusions that abut upon grooves provided for the movable carriage, comprises fixing means for fixing the ink jet recording cartridge in the same condition as being mounted on the carriage; discharge port recognition means for recognizing the positions of the discharge ports of the fixed ink jet recording cartridge; an index of predetermined positions to store the predetermined positions of the discharge ports in relation to the carriage; calculating means for calculating specific distances for the portions of the extrusions abutting against the grooves to retract in the direction opposite to the abutting direction of the ink jet recording cartridge toward the carriage in accordance with the difference between the predetermined positions in relation to the carriage and the recognized positions of the discharge ports; an index of processing amounts to store the calculated specific distances; and retracting means for retracting the portions of the extrusions abutting against the grooves by the calculated specific distances in the direction or the apparatus of the present invention for manufacturing an ink jet recording cartridge, which is provided with an ink jet recording head for recording on a recording medium by discharge ink from the discharge ports, and a housing for holding the ink jet recording head, which is provided with adjusting means that abut upon the carriage for arranging the discharge ports of the ink jet recording cartridge in the predetermined position in the carriage when the ink jet recording cartridge is mounted on the movable carriage, and the adjusting means which is rotatively fixed to the housing, and structured by eccentric pin members having the contact surfaces in contact with the carriage which is made eccentric to the rotational shafts thereof, comprises fixing means for fixing the ink jet recording cartridge in the same condition as being mounted on the carriage; discharge port recognition means for recognizing the positions of the discharge ports of the fixed ink jet recording cartridge; an index of predetermined positions to store the predetermined positions of the discharge ports in relation to the carriage; calculating means for calculating the rotational amounts of the eccentric pin members in accordance with the difference between the predetermined positions in relation to the carriage and the recognized positions of the discharge ports; an index of rotational amounts to store the calculated rotational amounts of the eccentric pin members; and rotating means for rotating the eccentric pin members only by the calculated rotational amounts.

With the manufacturing apparatus of the present invention, it becomes possible to manufacture an ink jet recording cartridge capable of positioning the discharge ports of the recording head easily and exactly corresponding to the predetermined position in the carriage even if the precision varies when the recording head is installed on the cartridge.

In addition, the ink jet recording cartridge of the present invention may be manufactured by use of the apparatus for manufacturing an ink jet recording cartridge described above.

The recording apparatus of the present invention comprises an ink jet recording cartridge of the invention described above, and means for supplying driving signals applied to discharging ink from the ink jet recording head.

Also, the recording apparatus of the invention is provided with recording medium carrying means to carry a recording medium for receiving ink discharged from the ink jet recording head.

Also, it may be possible to structure the recording apparatus of the invention so as to perform recording by discharging ink from the ink jet recording head to adhere ink to a recording medium.

In accordance with the present invention described above, the portions of the extrusions that abut upon the grooves arranged for the carriage are allowed to retract in the direction opposite to the abutting direction of the ink jet recording cartridge against the carriage or by the adjusting means that abut upon the carriage when the ink jet recording cartridge is mounted on the carriage the discharge ports of the ink jet recording cartridge are arranged for the predetermined position in the carriage. Therefore, even if the precision varies when the recording head is installed on the housing of the cartridge, it becomes possible to position the discharge ports of the recording head easily and exactly corresponding to the predetermined position in the carriage.

BRIEF DESCRIPTION OF THE DRAWINGS

FIG. 22 is a table which shows one example of the index of the process amounts and the index of the predetermined positions.

FIG. 31 is the table which shows one example of the index of the rotational amounts and the index of the predetermined positions.

DETAILED DESCRIPTION OF THE PREFERRED EMBODIMENTS

Now, with reference to the accompanying drawings, the description will be made of the embodiments in accordance with the present invention.

(First Embodiment)

Figure 2:
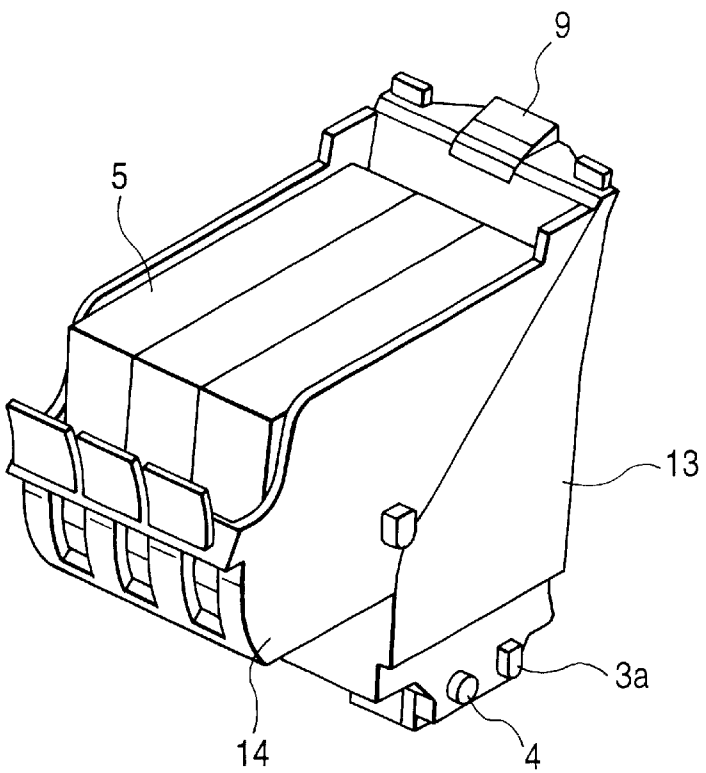
FIG. 2 is a perspective view which shows the ink tank and others of the ink jet recording cartridge represented in FIG. 1.
Figure 1:
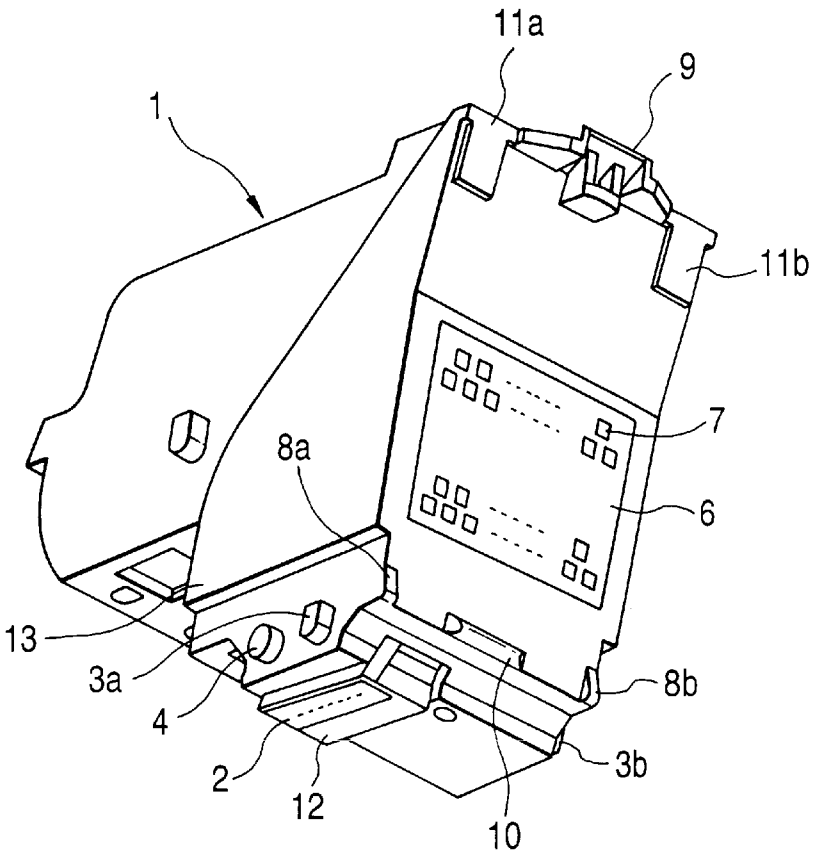
FIG. 1 is a perspective view which shows an ink jet recording cartridge in accordance with a first embodiment of the present invention.
Figure 3:
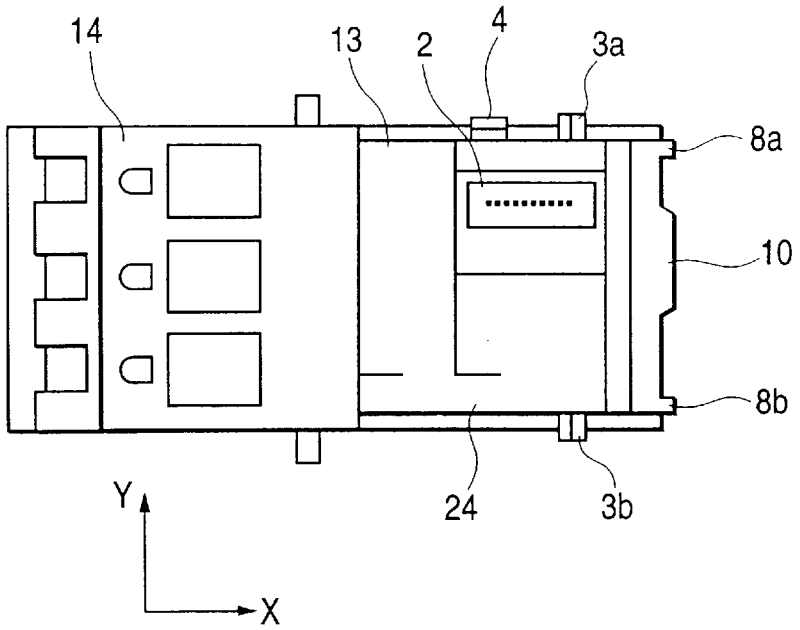
FIG. 3 is a bottom view which shows the ink jet recording cartridge represented in FIG. 1.

FIG. 1 is a perspective view which shows an ink jet recording cartridge in accordance with a first embodiment of the present invention. FIG. 2 is a perspective view which shows the ink tank and others of the ink jet recording cartridge represented in FIG. 1. FIG. 3 is a bottom view which shows the ink jet recording cartridge represented in FIG. 1.

The ink jet recording cartridge 1 of the present embodiment comprises the ink discharge member (an ink jet recording head) 12 where ink droplets are discharged from the discharge port array 2 formed by the discharge ports arranged in line to discharge ink droplets in accordance with printing signals; contact pads 7 to deliver the printing signals transmitted between the ink discharge member 12 and the recording apparatus main body (not shown); a housing 13 that supports the ink discharge member 12; ink tanks 5 (see FIG. 2) each containing ink to be supplied to the ink discharge member 12; and an ink tank supporting member 14 (see FIG. 2) that supports the ink tanks 5, among some others. Here, the detailed structure of the ink discharge member 12 for the present embodiment is the same as that of the convention ink jet recording head described with reference to FIG. 33. Therefore, the detailed description thereof will be omitted.

Also, both on the side faces of the ink jet recording cartridge 1, a first positioning extrusion 3*a*, a second positioning extrusion 3*b*, and a third positioning extrusion 4 are arranged, respectively, to perform abutting and positioning of the ink jet recording cartridge 1 in relation to the carriage (see FIG. 4) of the recording apparatus. Here, each side face of the ink jet recording cartridge 1 where each of the extrusions 3*a*, 3*b*, and 4 are arranged is placed almost perpendicular to the direction in which the carriage 15 (see FIG. 4) reciprocates with the cartridge 1 mounted on it.

Figure 4:
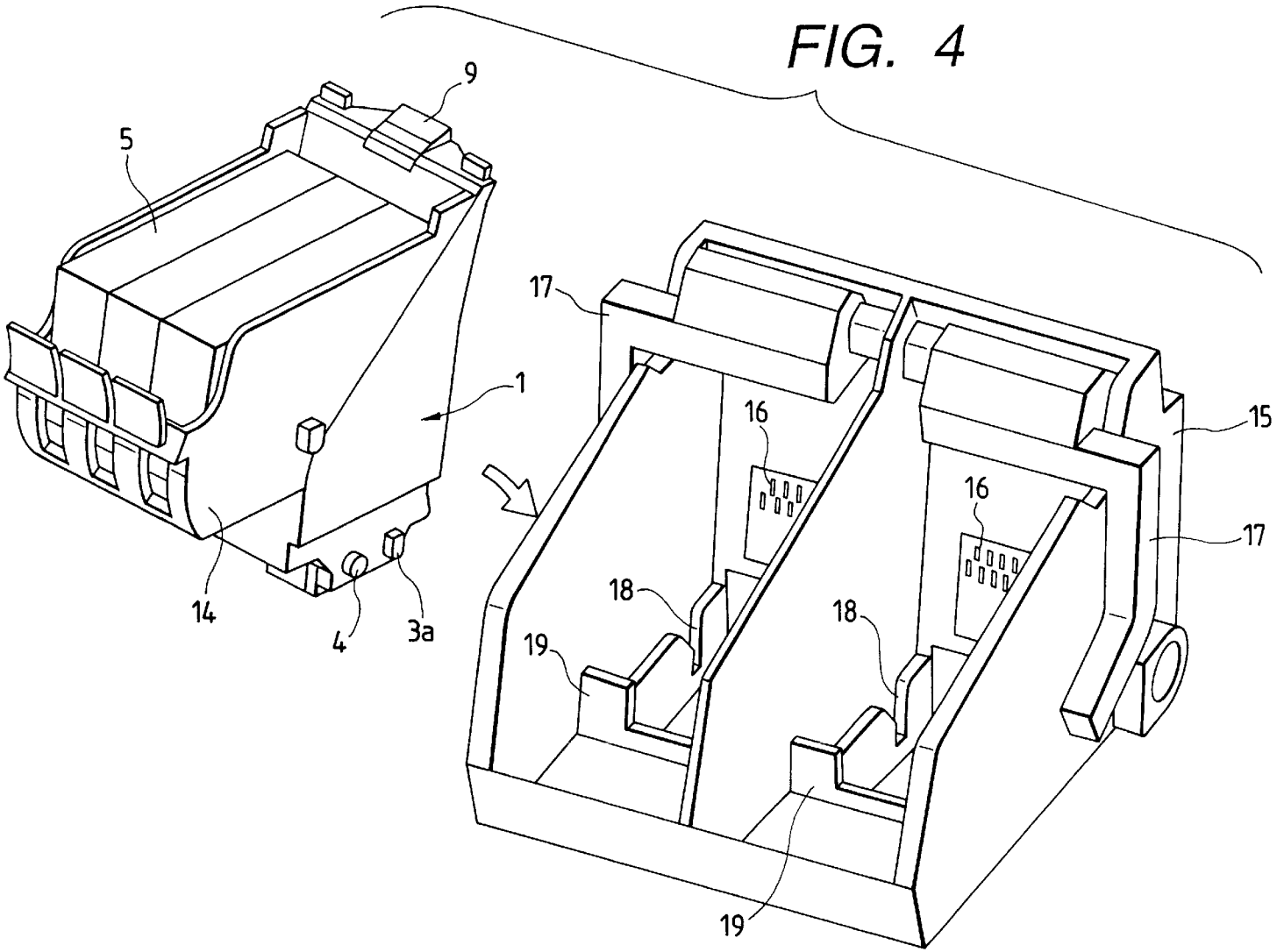
FIG. 4 is a perspective view which shows one example of a carriage detachably installed on the ink jet recording cartridge represented in FIG. 1 and others.

FIG. 4 is a perspective view which shows one example of the carriage having detachably mounted on it the ink jet recording cartridge represented in FIG. 1 and others.

The carriage 15 provided for the recording apparatus main body is the so-called two-pocketed type carriage which is capable of mounting two ink jet recording cartridges 1. It is structured to be able to attach the ink jet recording cartridge 1 and detach it by handling the lever 17. For the carriage 15, the contact points 16 are arranged to connect with the contact pads 7 (see FIG. 1) of the ink jet recording cartridge 1. The aforesaid printing signals are transmitted through these contact points 16. Also, in each pocket of the carriage 15, there are arranged a first positioning groove 21 (see FIG. 5), a second positioning groove 18, and a third positioning groove 22 (see FIG. 5) to position the ink jet recording cartridge 1 in relation to the carriage 15.

Figure 5:
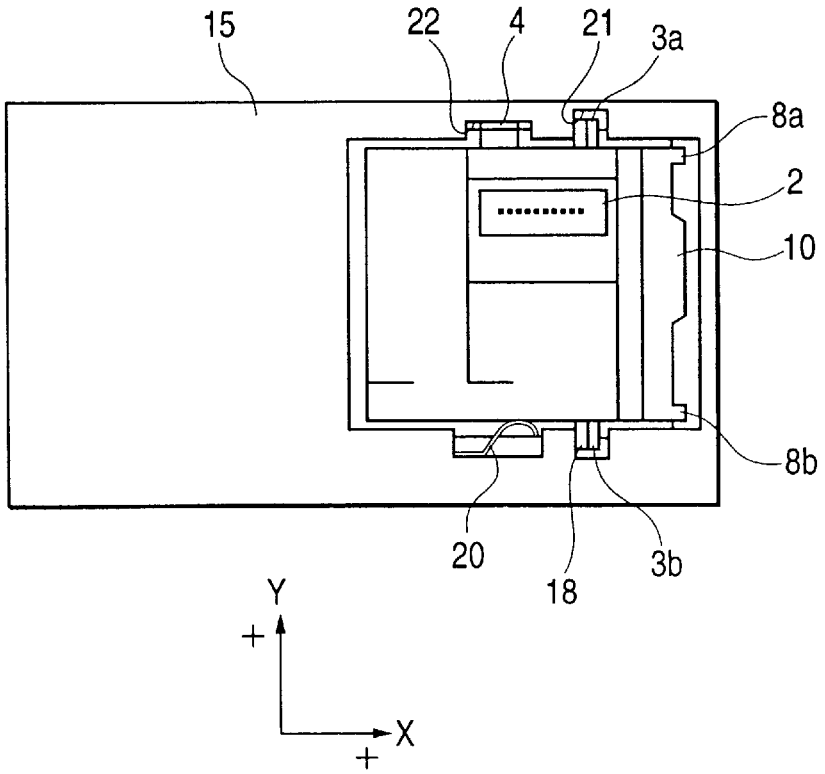
FIG. 5 is a bottom view which shows the state where the ink jet recording cartridge represented in FIG. 1 and others is installed on the carriage.

FIG. 5 is a bottom view which shows the state where the ink jet recording cartridge represented in FIG. 1 and others is installed on the carriage.

As described above, the first positioning groove 21, the second positioning groove 18, and the third positioning groove 22 are arranged for the carriage 15 to position the ink jet recording cartridge 1. Each of the positioning grooves 21, 18, and 22 corresponds to each of the positioning extrusions 3*a*, 3*b*, and 4 arranged for the ink jet recording cartridge 1, respectively.

As to the direction Y in FIG. 5, the ink jet recording cartridge 1 is pressed in the direction +Y by means of the flat spring 20 and others. Then, the portion of the third positioning extrusion 4, which is indicated by slanted lines in FIG. 5, is allowed to abut upon the third positioning groove 22, hence making the positioning in the direction Y. As to the direction X in FIG. 5, the ink jet recording cartridge 1 is pressed in the direction −X by means of the flat spring 20 and others (not shown). Then, the portions of the first positioning extrusion 3*a* and the second positioning extrusion 3*b*, which are indicated by slanted lines in FIG. 5, are allowed to abut upon the first positioning groove 21 and the second positioning groove 18, hence making the positioning in the direction X.

The height or width dimension of each of the positioning extrusions 3*a*, 3*b*, and 4 of the ink jet recording cartridge 1 is adjusted in order to compensate for the amount of deviation from the designed position of the ink discharge port array 2 derived from the errors in the assembling precision of the ink jet recording cartridge 1, as well as from the errors in the dimensional precision of each part.

For the dimensional adjustment of each of the positioning extrusions 3*a*, 3*b*, and 4, the positions of the plural discharge ports (the discharge ports on both end of the discharge port array 2, for example) of the ink discharge port array 2 are, at first, measured from the standard positions of X and Y of the ink jet recording cartridge 1 by means of the image processing or the like so as to work out the errors from the center of the designed position. Then, based upon the errors thus obtained, the amount of adjustment process is determined for each of the positioning extrusions 3*a*, 3*b*, and 4. The dimensional adjustment of each of the positioning extrusions is made by cutting off each portion of the positioning extrusions indicated by slanted lines in FIG. 5 by the amount needed for the intended adjustment. Here, in accordance with the present embodiment, two extrusions 3*a* and 3*b* are provided as the positioning extrusions in the direction X. Therefore, with a slight differentiation of the adjustment amounts of the extrusions 3*a* and 3*b*, it becomes possible not only to position the ink jet recording cartridge 1 to the carriage 15 in the direction X, but also, to compensate for the angular errors of the discharge port array 2.

Figure 6A:
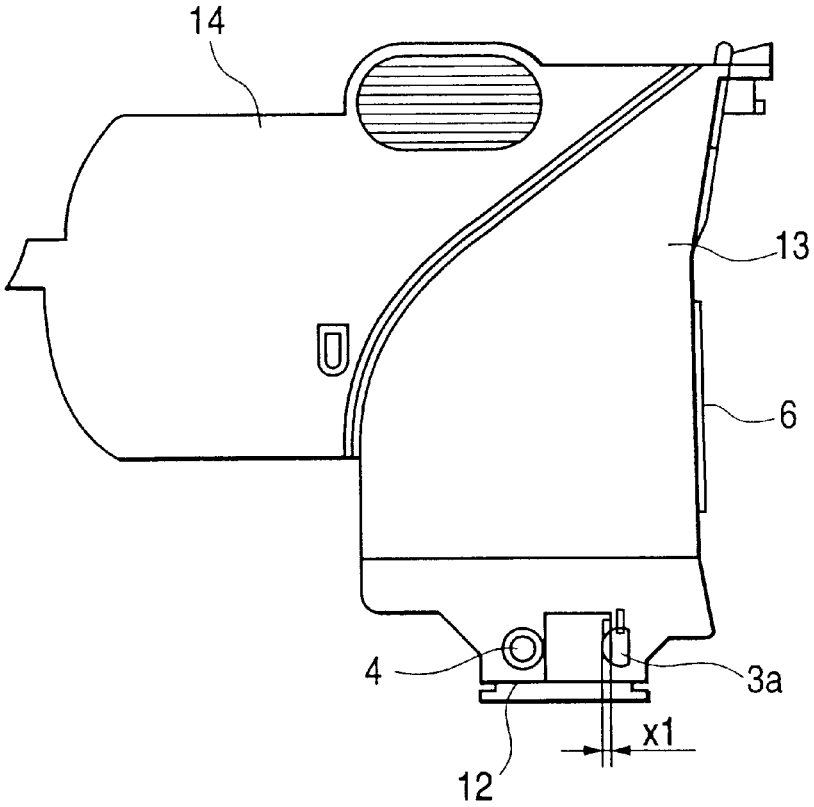
FIGS. 6A, 6B and 6C are views which illustrate the dimensional adjustment process of the first positioning extrusion of the ink jet recording cartridge.
Figure 6B:
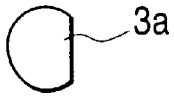
Figure 6C:
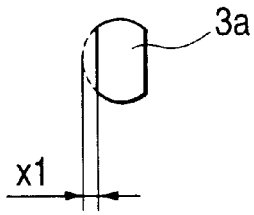

FIGS. 6A to 6C are views which illustrate the dimensional adjustment process of the first positioning extrusion of the ink jet recording cartridge.

As shown in FIG. 6A, the portion of the first positioning extrusion 3*a* which abuts upon the first positioning groove 21 (see FIG. 5) is cut off by the adjustment amount ×1 which has been determined as described above. In this way, the extrusion 3*a*, which has been configured to be convex on the left end side as shown in FIG. 6B before being cut, is now in a form to present a plane portion on the left end side as shown in FIG. 6C. Here, for the second portioning extrusion 3*b*, which is arranged on the side opposite to the first extrusion 3*a*, the dimensional adjustment process is made in the same manner.

Figure 7A:
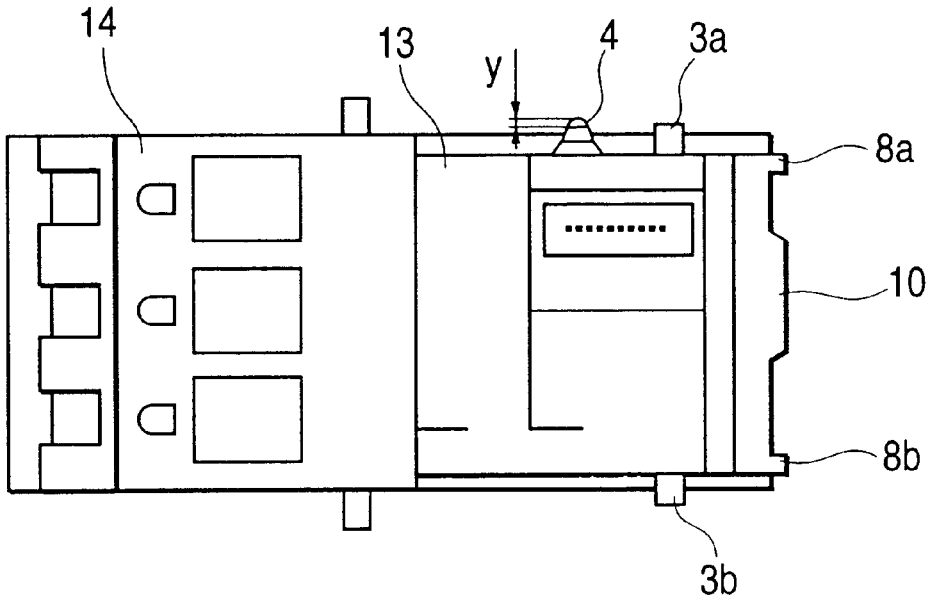
FIGS. 7A, 7B and 7C are views which illustrate the dimensional adjustment process of the third positioning extrusion of the ink jet recording cartridge.
Figure 7B:
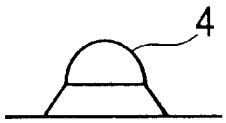
Figure 7C:
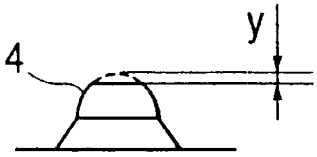

FIGS. 7A to 7C are views which illustrate the dimensional adjustment process of the third extrusion of the ink jet recording cartridge.

As shown in FIG. 7A, the portion of the third positioning extrusion 4, which abuts upon the third positioning groove 22 (see FIG. 5), is also cut off by the adjustment amount y determined as described above. In this way, the smooth semicircular upper end of the extrusion 4 as shown in FIG. 7B is configured to form the flat upper end as shown in FIG. 7C.

FIG. 8 to FIG. 13 are views which illustrate a series of operations to install the ink jet recording cartridge on the carriage and to remove it therefrom.

Figure 8:
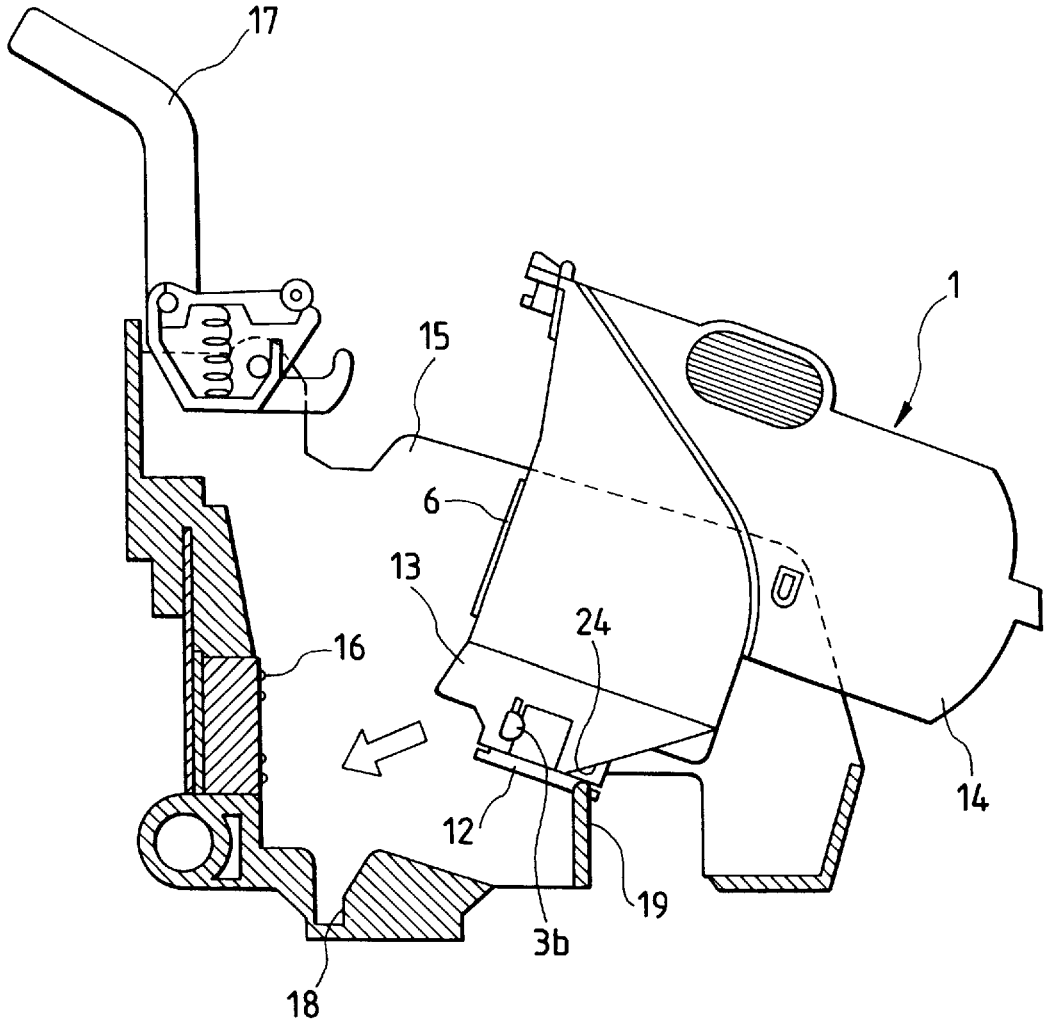
FIG. 8 is a view which shows the initial operation when the ink jet recording cartridge is installed on the carriage.

FIG. 8 is a view which shows the initial operation when the ink jet recording cartridge is installed on the carriage. The curved surface portion 24 of approximately 10 mm radius is arranged for the front edge portion of the surface of the housing 13 of the ink jet recording cartridge 1 where the ink discharge port member 12 is arranged. This curved surface portion 24 is allowed to slide on the upper end of the rib 19 of the carriage 15 when the ink jet recording cartridge 1 is inserted into the carriage 15. Then, the cartridge 1 enters the interior of the carriage 15 smoothly without being hooked by the rib 19 to present the state shown in FIG. 9.

Figure 9:
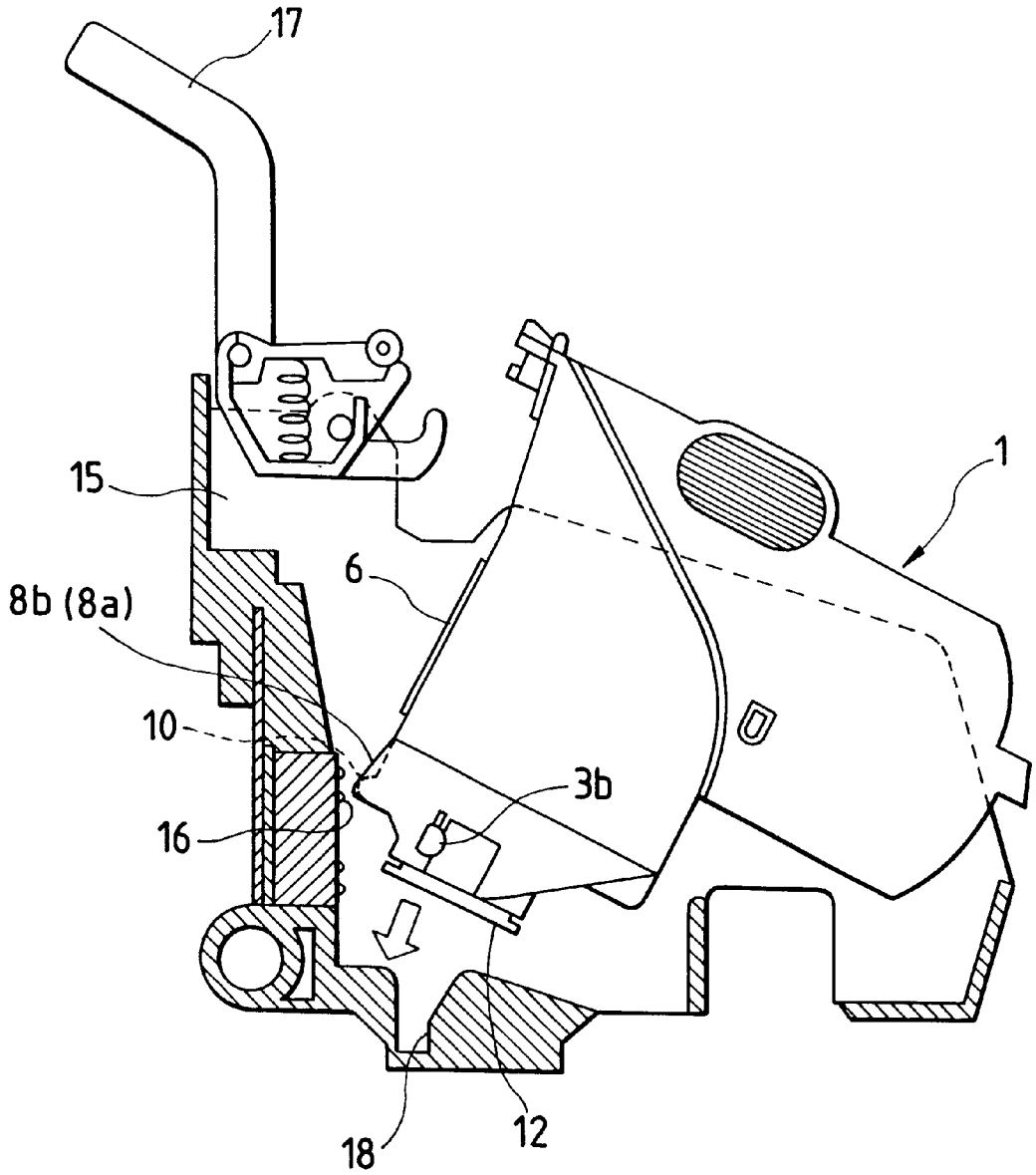
FIG. 9 is a view which shows the state where the ink jet recording cartridge is placed in the deeper inside of the carriage, and the end portion of the cartridge abuts upon the circumferential surface of the contact pads.

FIG. 9 is a view which shows the state where the ink jet recording cartridge is placed deeper inside the carriage, and the end portion of the cartridge abuts upon the circumferential surface of the contact pads.

Both on the lower ends of the back face of the ink jet recording cartridge 1 where the contact pad surface 6 is arranged, the triangular extrusion 8*b* (8*a*) configured to be a triangle is provided as also shown in FIG. 1. Here, the tip of each of the extrusions 8*a* and 8*b* is chamfered to present a curved surface.

When the ink jet recording cartridge 1 enters deeper inside the carriage 15 to abut upon the circumferential surface of the contact points 16 of the carriage 15, the triangular extrusions 8*a* and 8*b* are allowed to slide on the circumferential surface of the contact points 16 without being hooked by the contact points 16 and others, thus smoothly entering the interior of the carriage 15 deeper still. In this way, with the triangular extrusions 8*a* and 8*b* abutting upon the contact points 16, there is no possibility that the ink discharge port member 12 is in contact with the contact pads 16 to stain the contact points 16 with ink, and also, the discharge port surface of the ink discharge port member 12 is prevented from damages that may be caused otherwise.

Figure 10:
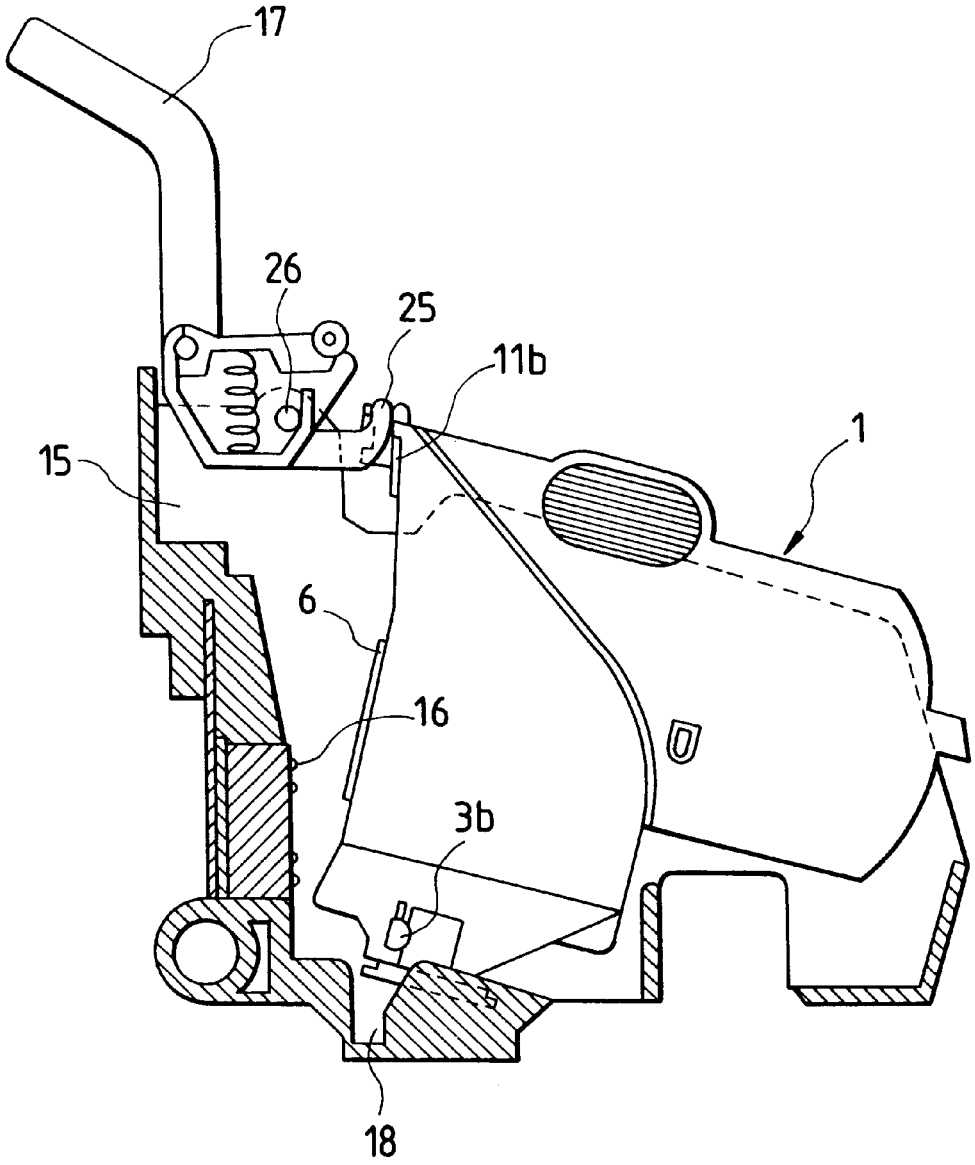
FIG. 10 is a view which shows the state where the cartridge stops at the position that enables it to stop naturally when the ink jet recording cartridge is inserted into the interior of the carriage.

Also, between the triangular extrusions 8*a* and 8*b* themselves, the rib type extrusion 10 is arranged as also shown in FIG. 1. Therefore, with the rib type extrusion 10 also abutting upon the contact points 16, there is no possibility that the ink discharge port member 12 is in contact with the contact pads 16 to stain the contact points 16 with ink, and it becomes possible to prevent the discharge port surface of the ink discharge port member 12 from being damaged. FIG. 10 is a view which shows the state where the cartridge stops in the position at which it is caused to stop naturally when the ink jet recording cartridge is inserted into the carriage. The lever 17 is structured to be rotative centering on the shaft 26. On the side of the lever 17 opposite to the shaft 26, the cartridge push-out member 25 is arranged to push out the ink jet recording cartridge 1. Therefore, interlocked with the rotation of the lever 17, the cartridge push-out member 25 operates so as to depress the cartridge 1.

As shown in FIG. 1, too, the inclined surface 11*b* (11*a*) is formed both on the upper ends of the back face of the ink jet recording cartridge 1 where the contact pad surface 6 is arranged. Thus, the cartridge 1 which has been inserted into the carriage 15 stops in the position where the inclined surface 11*b* (11*a*) is in contact with the cartridge push-out member 25.

Figure 11:
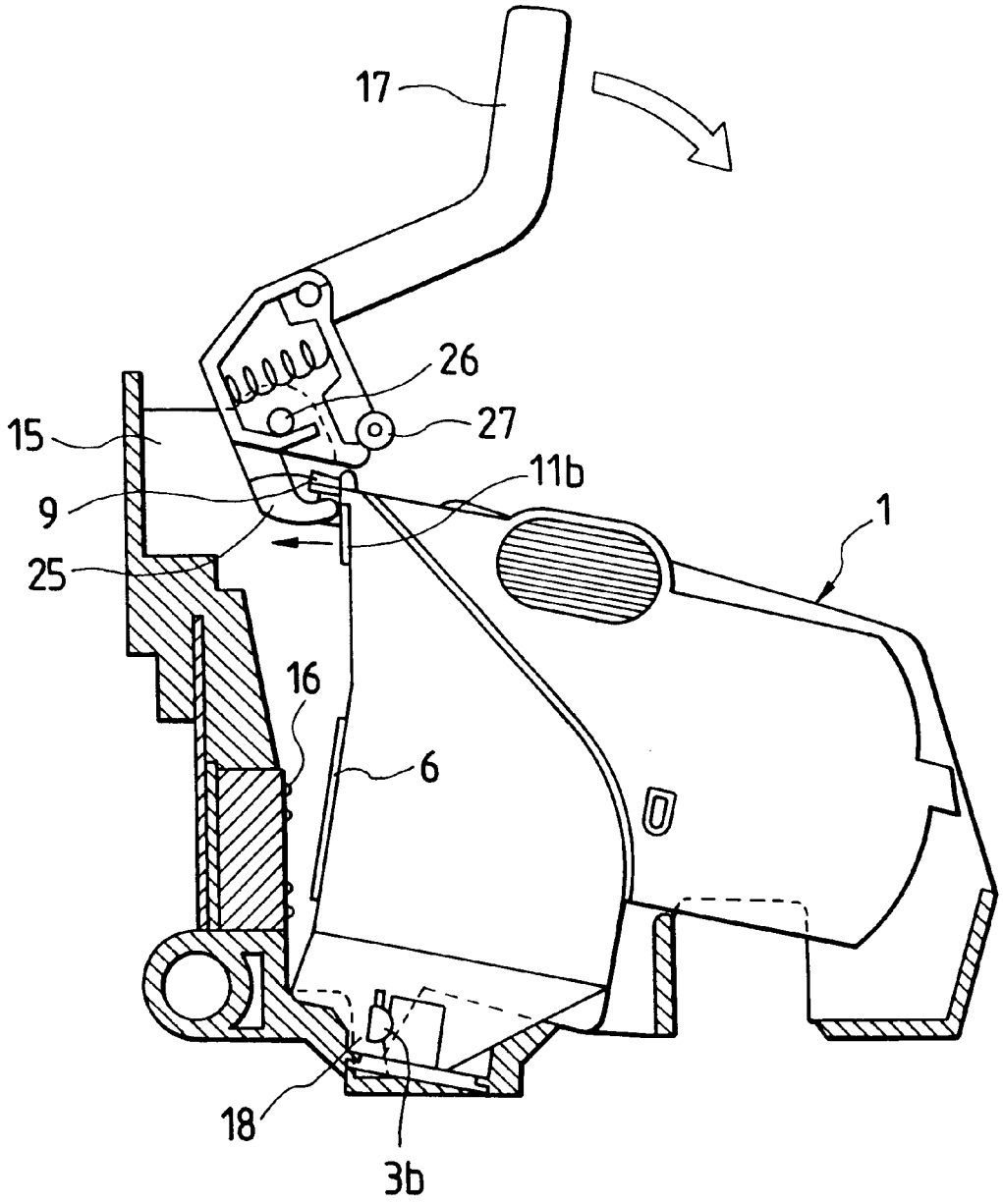
FIG. 11 is a view which shows the state of the process in which the lever is pressed downward for installing the ink jet recording cartridge in the interior of the carriage.

Then, as shown in FIG. 11, the lever 17 is pulled down to enable the leading end of the cartridge push-out member 25 to slide on the inclined surface 11*b* (11*a*) so that the ink jet recording cartridge 1 enters the carriage 15 deeper still. Along with this motion, each of the positioning extrusions 3*a*, 3*b*, and 4 are automatically allowed to enter each of the positioning grooves 21, 18, and 22 of the carriage 15. After that, interlocked with the movement of the lever 17, the pressure roller 27 operates to abut upon the extrusion 9 arranged on the upper end of the back face of the ink jet recording cartridge 1, hence pressing the cartridge 1 downward.

Figure 12:
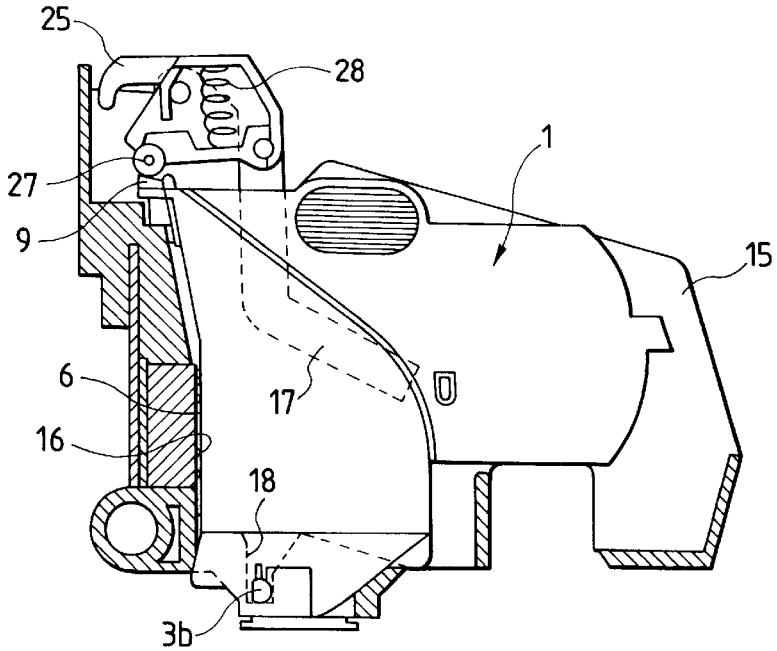
FIG. 12 is a view which shows the state where the lever is pressed down completely so that the ink jet recording cartridge is installed in the interior of the carriage.

FIG. 12 is a view which shows the state where the lever has been pressed down completely so that the ink jet recording cartridge is installed on the carriage. The pressure roller 27 presses the extrusion 9 downward in FIG. 12 by the repellent force of the spring 28 compressed by the lever 17 which has been pressed downward. The positioning of the cartridge 1 to the carriage 15 in the vertical direction in FIG. 12 is made when the first positioning extrusion 3*a* (see FIG. 1 and others) and the second positioning extrusion 3*b* abut upon the bottom face of the first positioning groove 21 (see FIG. 5) and the second positioning groove 18 of the carriage 15, respectively. Also, the contact points 16 of the carriage 15 compress the contact pad surface 6 of the cartridge 1 by means of a spring (not shown) arranged on the reverse side of the contact points 16. Therefore, the cartridge 1 pressed forward (in the right-hand direction in FIG. 12). In this way, the first positioning extrusion 3*a* and the second positioning extrusion 3*b* abut upon the right side of each of the positioning grooves 21 and 18 in FIG. 12, hence positioning the cartridge 1 to the carriage 15 in the horizontal direction.

Figure 13:
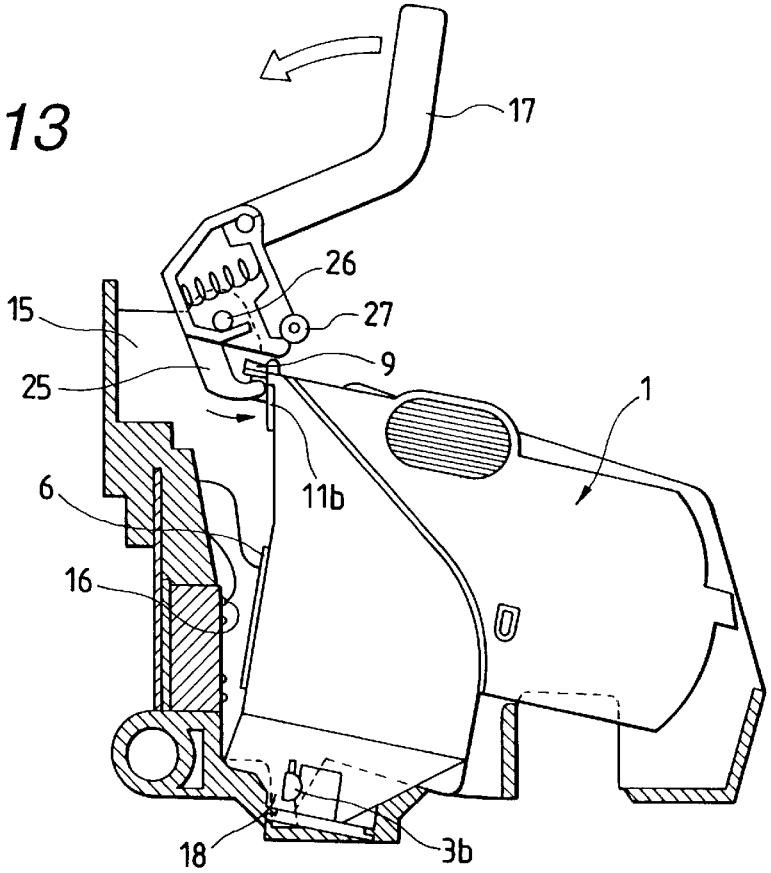
FIG. 13 is a view which shows the operation to remove the cartridge from the carriage.

FIG. 13 is a view which shows the operation to remove the cartridge from the carriage. As shown in FIG. 13, the lever 17 is pulled up to release the pressure roller 27 from the extrusion 9. Then, the leading end of the cartridge push-out member 25 presses the front surface side (in the right-hand direction in FIG. 13) of the cartridge 1 outward, while sliding on the inclined surface 11*b* (11*a*). Thus, the operation is smoothly made to remove the cartridge 1 from the carriage 15.

As described above, in accordance with the ink jet recording cartridge 1 of the present embodiment, the abutting portion of each of the positioning extrusions 3*a*, 3*b*, and 4, which abuts upon each of the positioning grooves 18, 21, and 22 of the carriage 15 is additionally processed so that each of them is retracted in the direction opposite to the abutting direction of the cartridge 1 against the carriage 15 on the basis of the adjustment amount calculated by the positional errors of the discharge port array 2 on the cartridge 1. Thus, the relative positions between the cartridge 1 and the carriage 15 can be adjusted to make it possible to provide the positional precision for the cartridge 1 to the carriage 15, and also, to compensate for the angular errors or the like of the discharge port array 2 easily. Therefore, the discharge port array 2 of the cartridge 1 can be arranged for the carriage 15 on the predetermined position easily and exactly.

(First Variational Example)

Figure 14A:
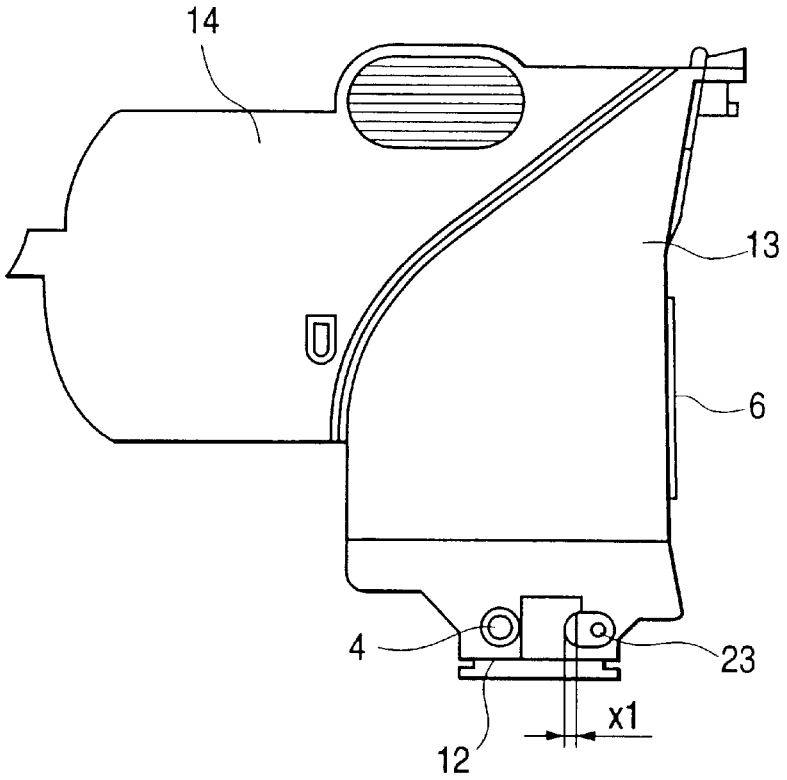
FIGS. 14A, 14B and 14C are side views which illustrate a first variational example of the ink jet recording cartridge shown in FIG. 1 and others.
Figure 14B:
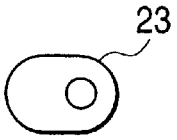
Figure 14C:
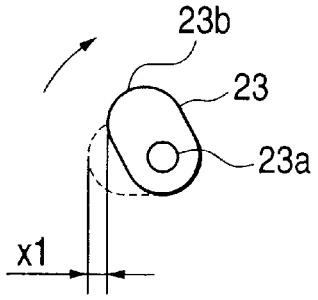

FIGS. 14A to 14C are side views which illustrate a first variational example of the ink jet recording cartridge represented in FIG. 1 and others. Here, the same reference marks are applied to the same structure of the ink jet recording cartridge shown in FIGS. 14A to 14C as those applied to the ink jet recording cartridge shown in FIG. 1 and others. Then, the detailed description thereof will be omitted.

As shown in FIGS. 14A to 14C, the ink jet recording cartridge of this variational example is provided with the eccentric cam 23 as the structure which is arranged in place of the first and second positioning extrusions of the cartridge shown in FIG. 1 and others. As shown in FIG. 14C, the eccentric cam 23 is structured to rotate centering on the central axis 23*a*.

In accordance with this variational example, the eccentric cam 23 is allowed to rotate so that the contact point 23*b* which abuts upon the positioning groove of the carriage moves in a desired adjustment amount ×1 as shown in FIG. 14C. The eccentric cam 23, which is provided on the opposite side of the cartridge, is likewise allowed to rotate so that the contact point 23*a* moves in a desired adjustment amount. Therefore, in accordance with this variational example, if there occurs a need for readjustment of the adjustment amount of the eccentric cam 23 which functions as the positioning extrusion as the result of the remeasurement of the positional errors of the discharge port array, for example, it is possible to readjust the adjustment amount of the eccentric cam 23 by changing the movement width of the contact point 23*b* with the rotation of the eccentric cam 23.

(Second Variational Example)

Figure 15:
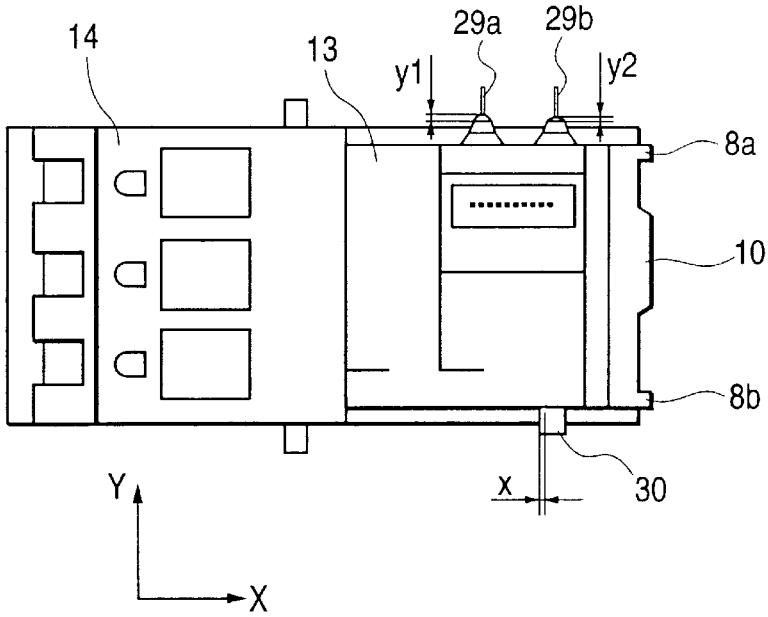
FIG. 15 is a side view which illustrates a second variational example of the ink jet recording cartridge shown in FIG. 1 and others.

FIG. 15 is a side view which shows a second variational example of the ink jet recording cartridge represented in FIG. 1 and others. Here, the same reference marks are applied to the same structure of the ink jet recording cartridge shown in FIG. 15 as those applied to the ink jet recording cartridge shown in FIG. 1 and others. Then, the detailed description thereof will be omitted.

The ink jet recording cartridge of this variational example is provided with a first extrusion 29*a* and a second extrusion 29*b* as the positioning extrusions in the direction Y in FIG. 15. A third extrusion 30 is provided as the positioning extrusion in the direction X in FIG. 15. In accordance with this variational example, too, a difference is given to the adjustment amount y1 of the first extrusion 29*a* and the adjustment amount y2 of the second extrusion 29*b* to make it possible to position the ink jet recording cartridge to the carriage in the direction Y, as well as to compensate for the angular errors of the discharge port array.

(Second Embodiment)

Figure 16:
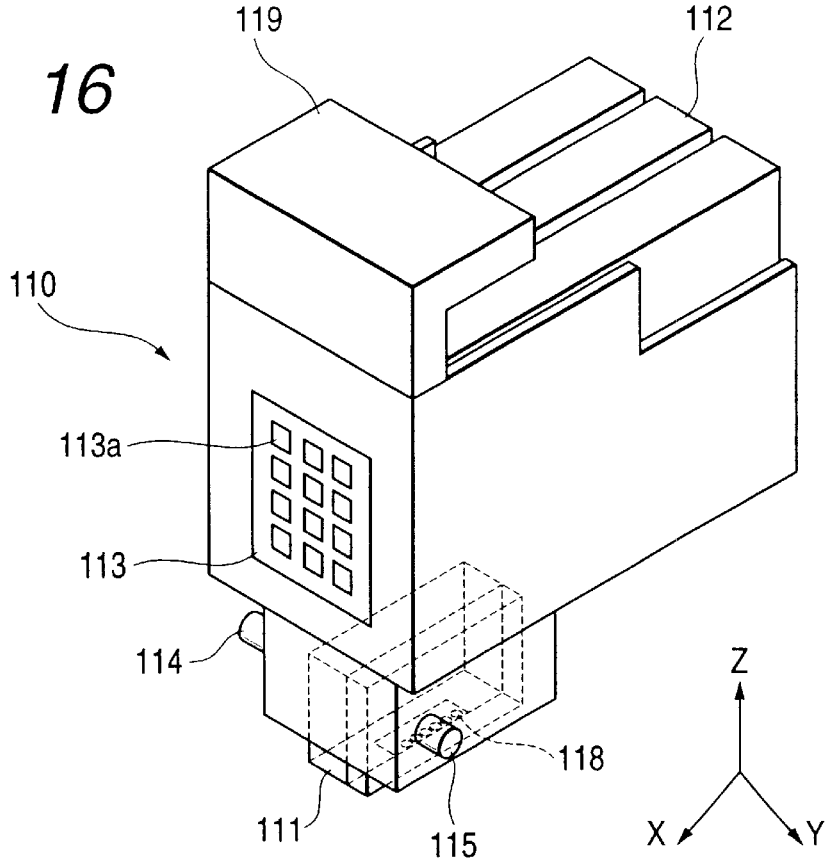
FIG. 16 is a perspective view which shows the ink jet recording cartridge in accordance with a second embodiment of the present invention.

FIG. 16 is a perspective view which shows the ink jet recording cartridge in accordance with a second embodiment of the present invention.

In a predetermined position on the lower face of the ink jet recording cartridge 110 of the present embodiment, the ink jet recording head 111 is fixed, which is structured in the same manner as the conventional art described with reference to FIG. 33. Also, for the cartridge 110, three ink tanks 112 are installed to contain ink to be supplied to the recording head 111. Here, the ink jet recording cartridge 110 is the so-called one head three-ink tank type where three colors of ink are supplied to one recording head.

On the back face of the ink jet recording cartridge 110, the flexible board 113 is installed with the contact pads 113*a* arranged to receive printing signals from the ink jet recording apparatus main body. One end portion of the flexible board 113 is connected with the ink jet recording head 111 to drive the recording head 111 in accordance with the printing signals thus received, hence discharging ink droplets from the discharge ports 118.

Also, on the side face of the ink jet recording cartridge 110, a first extrusion 114, a second extrusion 115, and a third extrusion (not shown) are arranged. When these extrusions abut upon the predetermined positions of the carriage provided for the ink jet recording apparatus, the cartridge 110 is positioned to the carriage.

Figure 17B:
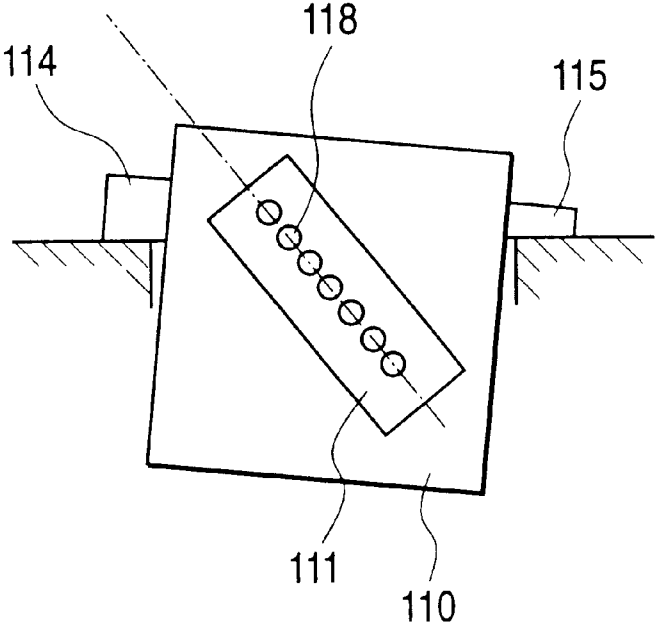
FIGS. 17A and 17B are views which schematically illustrate the arrangement angle of the discharge ports of the ink jet recording cartridge shown in FIG. 16 to the contact surface of the carriage.
Figure 17A:
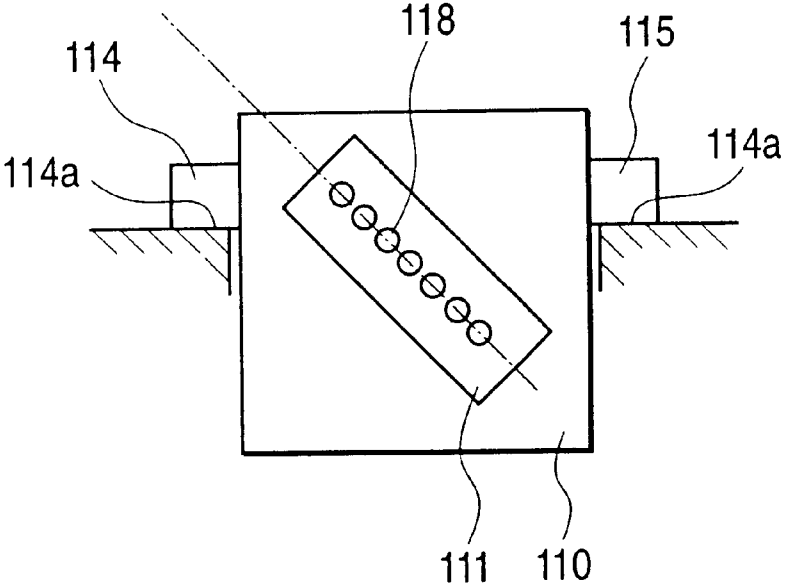

FIGS. 17A and 17B are views which schematically illustrate the arrangement angle of the discharge ports of the ink jet recording cartridge shown in FIG. 16 to the carnage abutting surface. FIG. 17A shows the state before the arrangement angle of the discharge ports is modified. FIG. 17B shows the state after the arrangement angle of the discharge ports is modified.

As shown in FIGS. 17A and 17B, each portion of the extrusions 114 and 115 of the ink jet recording cartridge 110, which abuts upon the carriage abutting surface 114*a* is processed with a difference in the processing amounts to each other so as to position the cartridge 110 at an angle to the carriage abutting surface which serves as the predetermined referential surface. Therefore, even if the ink jet recording head 111 is installed on the ink jet recording cartridge 110 with an error, it becomes possible to modify such installation error of the recording head 111 to the cartridge 110 by mounting the cartridge 110 on the carriage with an inclination equivalent to the amount of such error.

Now, with reference to FIGS. 18A and 18B and FIG. 19, the description will be made of the method for manufacturing the ink jet recording cartridge shown in FIG. 16.

Figure 18A:
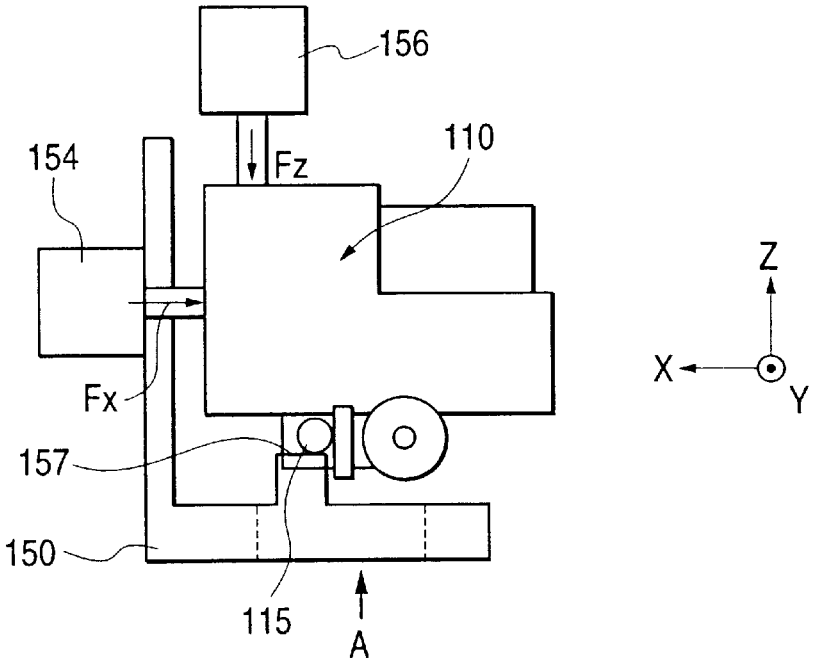
FIGS. 18A and 18B are views which illustrate the state where the ink jet recording cartridge shown in FIG. 16 is mounted on a manufacturing apparatus.
Figure 18B:
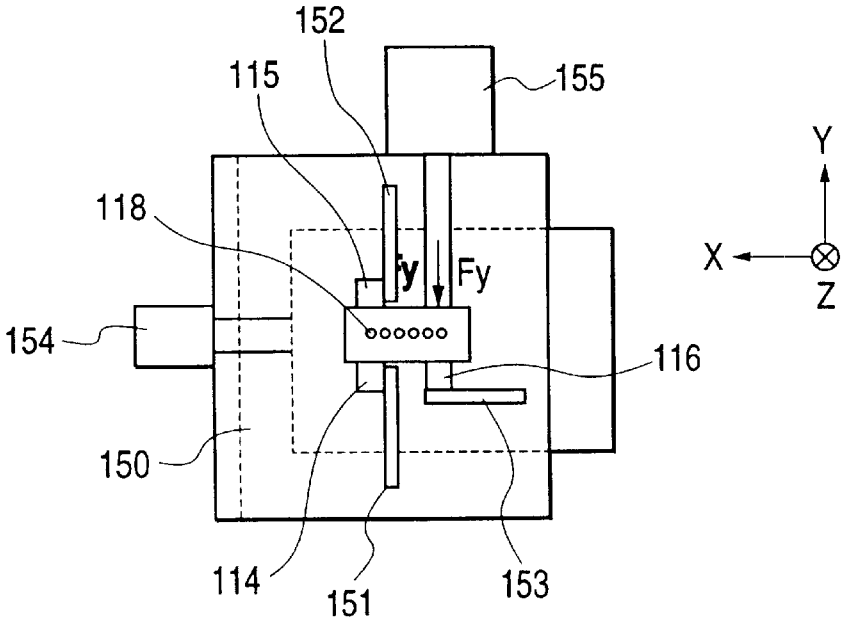

FIGS. 18A and 18B are views which illustrate the state where the ink jet recording cartridge shown in FIG. 16 is mounted on the manufacturing apparatus. FIG. 18A is the side view. FIG. 18B is a view observed in the direction indicated by an arrow A in FIG. 18A. Also, FIG. 19 is a view which shows the imaging system that takes the picture of the discharge port portion of the ink jet recording cartridge mounted on the manufacturing apparatus shown in FIGS. 18A and 18B. As shown in FIGS. 18A and 18B, the manufacturing apparatus, which manufactures the ink jet recording cartridge 110 of the present embodiment, comprises the installation frame 150 having the positioning unit 157 to mount each of the extrusions 114 and 115 of the cartridge 110 and position the cartridge 110 in the direction Z in FIGS. 18A and 18B; the contact cylinder 154 to press the cartridge 110 in the direction X in FIGS. 18A and 18B; the clamping cylinder 155 to press the cartridge 110 in the direction Y in FIGS. 18A and 18B; and the clamping cylinder 156 to press the cartridge 110 in the direction Z in FIGS. 18A and 18B. The contact cylinder 154, and the clamping cylinders 155 and 156, which serve as fixing means to fix the cartridge 110 in the same condition as it is mounted on the carriage, exert the loads Fx, Fy, and Fz, respectively. Further, for the manufacturing apparatus, the horns 151, 152, and 153 are provided, that is, the ultrasonic vibrating members which are structured to vibrate metallic members by use of piezoelectric devices, and serve as means for retracting each of the abutting portions of extrusions against each of the grooves in the predetermined directions and distances.

The contact cylinder 154 presses the contact pads 113*a* of the cartridge 110 (see FIG. 16). Each of the clamping cylinders 154 and 155 presses the position corresponding to the position that receives the load from the clutch mechanism (not shown) provided for the ink jet recording apparatus to fix the ink jet recording cartridge 110. Here, since the main body of the ink jet recording cartridge 110 is formed by resin material, such as polypherene sulfide (Noryl manufactured by GE Inc., for example), this body tends to be deformed by the pressurized load from the clutch mechanism serving as means for fixing the cartridge 110. Therefore, the position of the discharge ports 118 is adjusted, while satisfying the clumping conditions in consideration of the anticipated actual loads, the pressurized positions, and the like at the time of mounting the cartridge 110 on the ink jet recording apparatus. Then, it is made possible to offset in advance the influence of such deformation due to the pressurized load.

When the ink jet recording cartridge 110 is fixed on the manufacturing apparatus, the clamping cylinder 155 is driven at first, hence enabling the third extrusion 116 to abut upon the third horn 153. Then, the contact cylinder 154 is driven to enable the first extrusion 114 to abut upon the first horn 151, and the second extrusion 115 upon the second horn 152, respectively. Lastly, the clamping cylinder 156 is driven to press the pressure unit 119 of the cartridge 110 (see FIG. 16). Thus, the ink jet recording cartridge 110 is positioned and fixed on the installation frame 150 of the manufacturing apparatus.

In continuation, then, each of the horns is vibrated at high frequency, while each of the extrusions 114, 115, and 116 abuts upon each of the horns 151, 152, and 153, respectively. In accordance with the present embodiment, the vibrating frequency of each horn is set at 20 kHz. Then, the driving signal is applied to each piezoelectric device so that each of the metallic members presents its amplitude of 20 $\mu$m in the portion where it abuts upon each of the extrusions. Thus, each of the extrusions is additionally processed.

Figure 19:
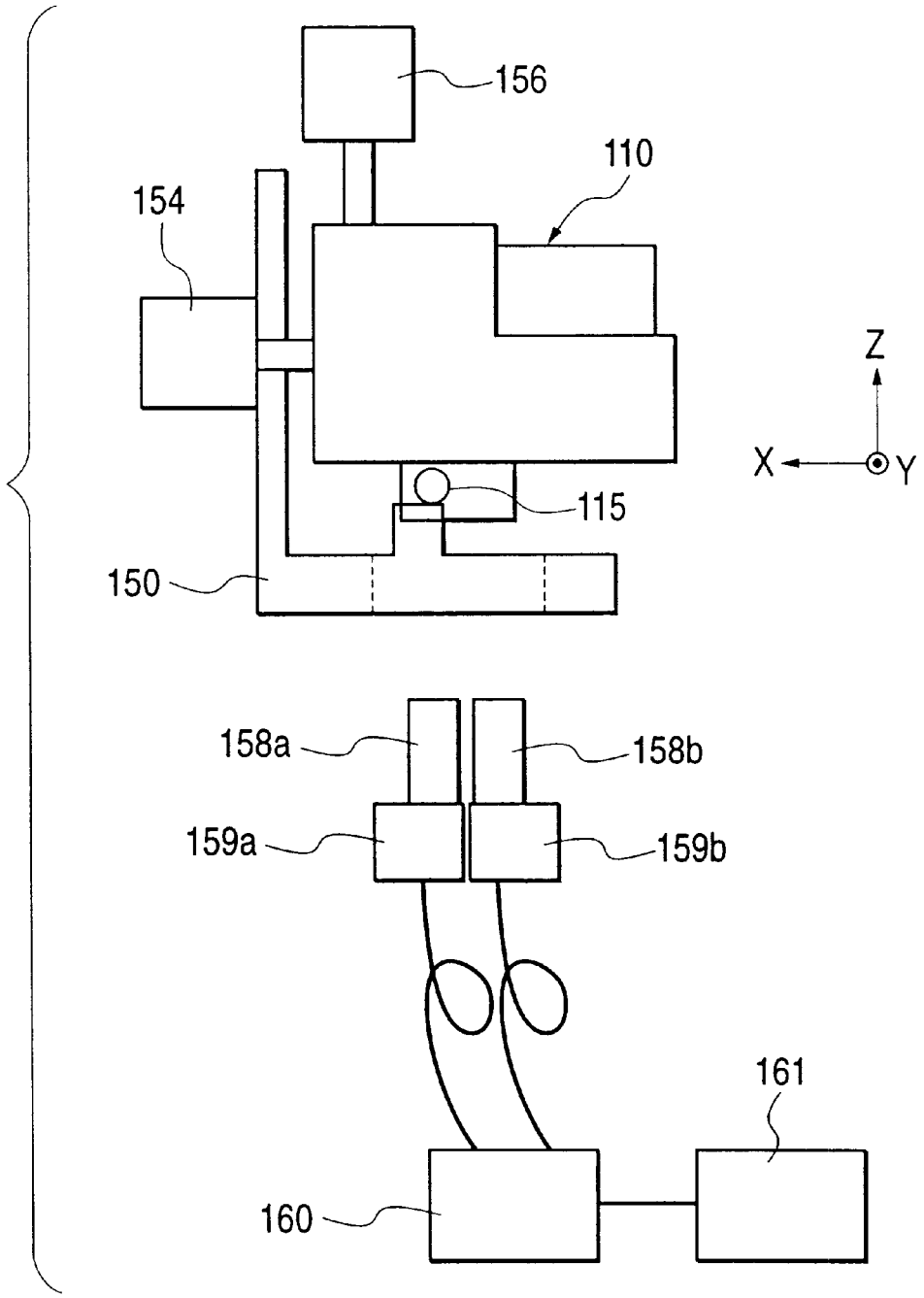
FIG. 19 is a view which shows the imaging system which takes the picture of the discharge portion of the ink jet recording cartridge mounted on the manufacturing apparatus represented in FIGS. 18A and 18B.

Also, as shown in FIG. 19, there are provided below the installation frame 150 the macro lenses 158*a* and 158*b*, and the CCD cameras 159*a* and 159*b* as discharge port recognition means for recognizing the position of the discharge ports 118 by imaging the discharge ports 118 of the cartridge 110. Each of the macro lenses and CCD cameras is fixed on the movable stage (not shown) in the direction Z in FIG. 19. Then, it is arranged so that the discharge ports 118 are in focus when the cartridge 110 is fixed to the installation frame 150.

On the lower face of the installation frame 150, a transparent window portion is arranged to make the discharge ports 118 of the cartridge 110 observable through the window portion. The picture of the discharge ports 118 taken by each of the CCD cameras 159*a* and 159*b* is transferred to the image processing device 160 which is controlled by the controller 161.

Figures 20A, 20B:
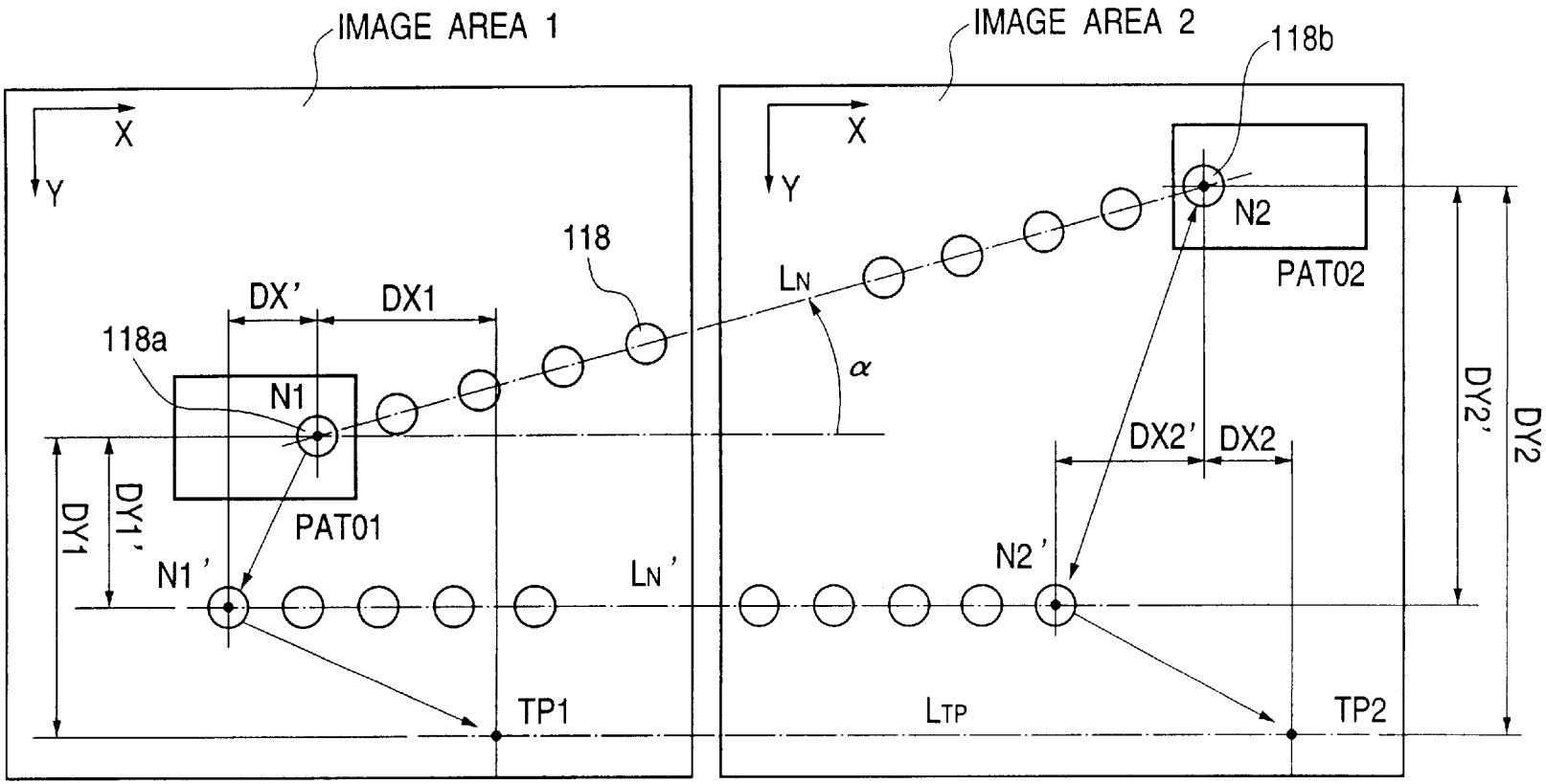
FIGS. 20A and 20B are views which shows one example of the picture of the discharge ports taken by the imaging system represented in FIG. 19.

FIGS. 20A and 20B are views which illustrate the example of the discharge port pictures taken by the imaging system shown in FIG. 19. FIG. 20A shows the case where the first discharge port 118*a* is recognized by use of the image pattern called "PAT01" registered on the controller in advance. FIG. 20B shows the case where the 160th discharge port 118*b* is recognized by use of the image pattern called "PAT02" registered on the controller in advance.

Each position of discharge ports is recognized by means of the general pattern matching with several image patterns characteristic of the discharge ports, which are registered on the controller in advance, and used appropriately. The coordinate value N1 of the central position of the first discharge port 118*a*, and the coordinate value N2 of the central position of the 160th discharge port 118*b* are transferred to the controller 161 and stored on it. In this respect, the coordinate value of the central position of each discharge port is represented by the pixel number in the X, Y directions in FIGS. 20A and 20B from the upper left side of each screen.

Figure 21:
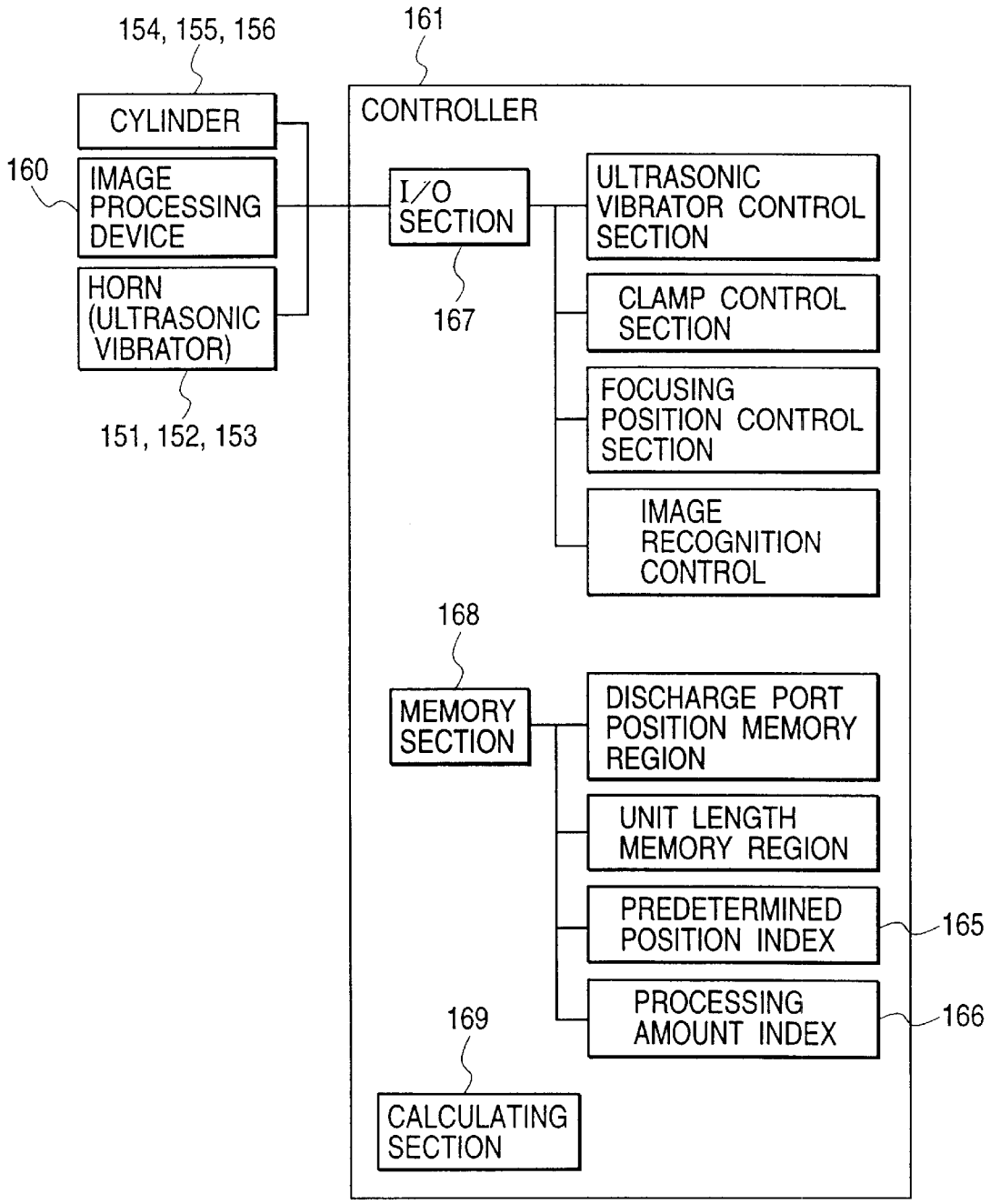
FIG. 21 is a block diagram which shows the controller represented in FIG. 19.

FIG. 21 is a block diagram which shows the controller represented in FIG. 19.

As shown in FIG. 21, the controller 161 comprises the I/O unit 167; the storage 168; and the arithmetic unit 169. The I/O unit 167 is an interface through which signals are transmitted and received between the image processing device 160, each of the cylinders 154, 155, and 156, and the ultrasonic oscillators 151, 152, and 153. The storage 168 is formed by the discharge port position storing region; the unit length storing region; the index 165 of the predetermined positions; and the index 166 of the processing amounts. On the discharge port position storing region, the discharge port position coordinates, which are transmitted from the image processing device 160, are stored. On the unit length storing region, the equivalent length per pixel in each imaging area of the CCD cameras 159*a* and 159*b* is stored. By the arithmetic unit 169, each processing amount of the extrusions 114, 115, and 116 (see FIGS. 18A and 18B), and the processing time of each ultrasonic oscillator are worked out on the basis of the data stored on the storage unit 168.

Now, the description will be made of the method for adjusting the discharge port positions of the ink jet recording cartridge 110 by use of the manufacturing apparatus described above.

At first, the equivalent length is worked out per pixel in the X, Y directions in the imaging area of each of the CCD cameras 159*a* and 159*b*, which is registered on the unit length storing region of the controller 161.

Then, the registration is made as to the predetermined positions which are the target positions of the discharge ports to be adjusted. When the predetermined positions are registered, the ink jet recording cartridge (hereinafter referred to as the "master cartridge M"), which has the specific relationship established between each abutting portion of the extrusions and the discharge port positions, is fixed at first to the installation frame 150 of the manufacturing apparatus as described above. Then, the discharge port positions of the master cartridge M are recognized by the application of the image recognition method described in conjunction with FIGS. 20A and 20B. After that, the discharge port positions thus recognized are registered on the index 165 of the predetermined positions of the controller 161. Then, all the discharge port positions of the ink jet recording cartridge 110 which should be adjusted are adjusted to the discharge port positions of the master cartridge M.

Subsequently, each shifted amount of the discharge ports in the imaging areas of the CCD cameras, which corresponds to each processing amount of the extrusions 114, 115, and 116, is registered on the processing amount index 166.

FIG. 22 is a view which shows one example of the processing amount index. The θ table indicates the arrangement angle α[°] of the discharge port to be corrected by processing the first extrusion 114; the relationship between the processing amount UX1[$\mu$m] of the first extrusion 114 and the processing time (the driving time of the first horn 151) MX 1[s]; and the pixel numbers that represent the deviated amounts created by processing in the X, Y directions from the original position of the discharge port. Also, likewise, the translation table indicates each of the processing amounts UX1, UX2, and UY[$\mu$m], and processing time MX1, MX2, MY[s] of the first extrusion 114, the second extrusion 115, and the third extrusion 116, respectively, and the pixel numbers that represent the shifted amount of the discharge port in the X, Y directions.

Then, the ink jet recording cartridge 110 which should be additionally processed is fixed on the manufacturing apparatus, and the positions of the discharge ports 118 are recognized by means of imaging. The difference between the positions of the discharge ports 118 thus recognized and the target positions registered on the index 165 of the specific positions is worked out as described above so as to define each of the processing amounts of the first extrusion 114 and the second extrusion 115 in accordance with the data stored on the index 166 of the processing amounts.

Here, with reference to FIGS. 20A and 20B again, the description will be made of the method for setting the processing amount of each of the extrusions 114 and 115.

In FIGS. 20A and 20B, the current positions of the first and 160th discharge ports are indicated by the reference marks N1 and N2, respectively. Then, the predetermined positions to which each of the discharge ports should be shifted are indicated by the reference marks TP1, and TP2, respectively. The adjustment amounts of the first discharge port 118*a* are indicated by the reference marks DX1 and DY1, and those of the 160th discharge port 118*b*, by DX2 and DY2, respectively. In this respect, the distance between the TP1 and the TP2 and the distance between the N1 and the N2 are the same. Here, the imaginary line LTP that connects the TP1 and the TP2 is assumed to be the X axis.

When each processing amount is set for the extrusions 114 and 115, the angle α to the axis X is, at first, worked out for the imaginary line LN that connects the N1 and the N2.

Then, in accordance with the processing amount index 166 of the θ adjustment table, the processing amount β1 is worked out for the first extrusion 114 in order to correct the angle α. If the first extrusion 114 should be processed by the processing amount β1, each of the discharge ports 118 shifts to the imaginary positions N1' and N2' so that the aforesaid imaginary line LN becomes the parallel line LN' to the X axis. Now that the first discharge port 118*a* shifts from the position N1 to the N1' in this manner, the distance of shift of the discharge port 118*a* from the position N1' to the position TP1 in the X, Y direction can be expressed as (DX1–DX1'), (DY1–DY1'), provided that each amount of shift in the X, Y directions is defined as DX1', DY1', respectively.

For example, if the angle α is 5°, the DX1 is 55 pixels, and the DY1 is 30 pixels, the processing amount UX1 of the first extrusion 114 is obtained to be 20 μm, and the processing time MX1, 0.02 s from the θ adjustment table. In this case, the DX1' becomes −5 pixels, and the DY1' becomes +10 pixels. As a result, (the DX1–the DX1') becomes 60 pixels, and (the DY1–the DY1') becomes 20 pixels. Then, from the translation table, the processing amount UX1, UX2 is obtained to be 300 μm and the processing time MX1, MX2, 0.3 s both for the first extrusion 114 and the second extrusion 115. Thus, in consideration of the previous θ adjustment portions, the total processing amount for the first extrusion 114 becomes 320 μm and the processing time, 0.32 s. Also, the processing amount UY of the third extrusion 116 is obtained to be 50 μm and the processing time thereof, 0.1 s from the translation table.

With the procedures described above, each driving time of the horns (ultrasonic oscillators) is worked out to be 0.32 s for the first horn 151; 0.3 s for the second horn 152; and 0.1 s for the third horn 153, respectively. With each of the ultrasonic oscillators being driven only for such driving time, the first discharge port 118*a* shifts to the position TP1, and the 160th discharge port 118*b* to the position TP2. As a result, the discharge ports 118 of the cartridge 110 are arranged in the predetermined positions of the carriage easily and exactly.

(Third Embodiment)

Figure 23:
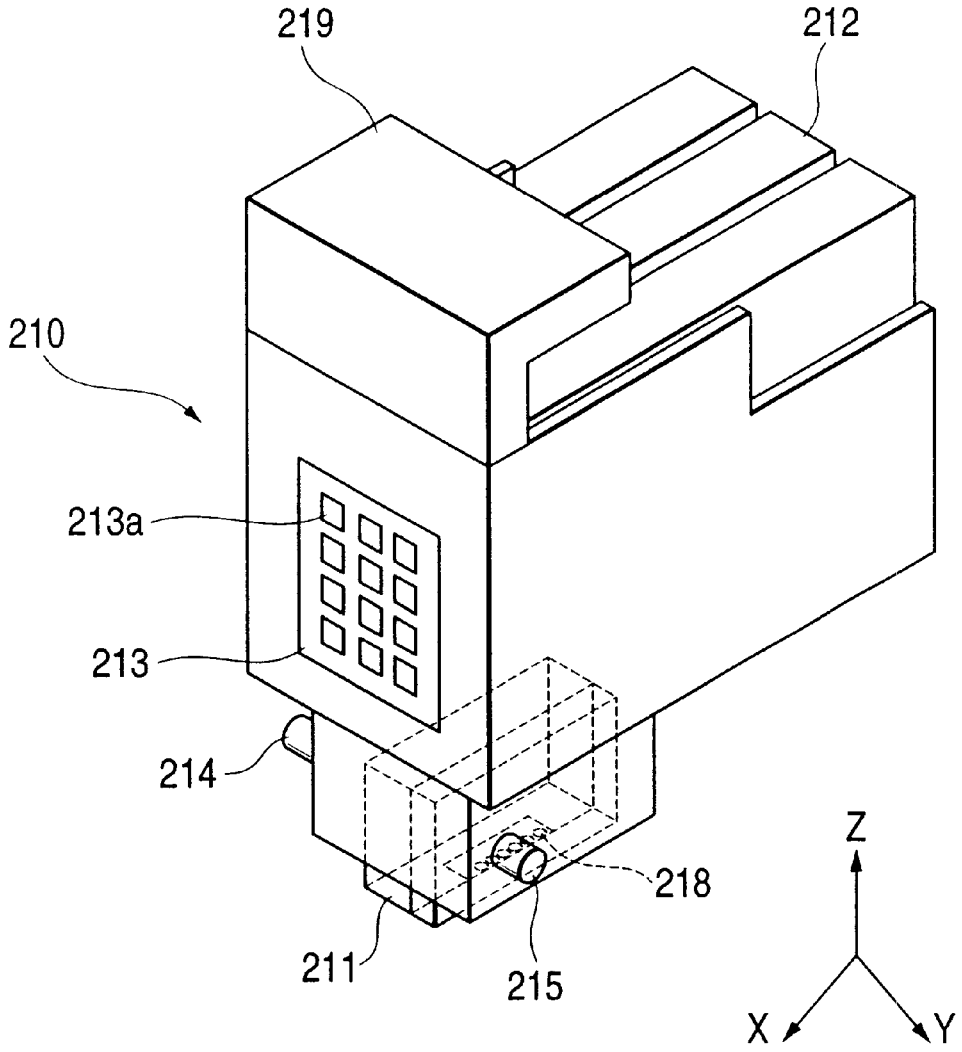
FIG. 23 is a perspective view which shows the ink jet recording cartridge in accordance with a third embodiment of the present invention.

FIG. 23 is a perspective view which shows the ink jet recording cartridge in accordance with a third embodiment of the present invention.

Figure 33:
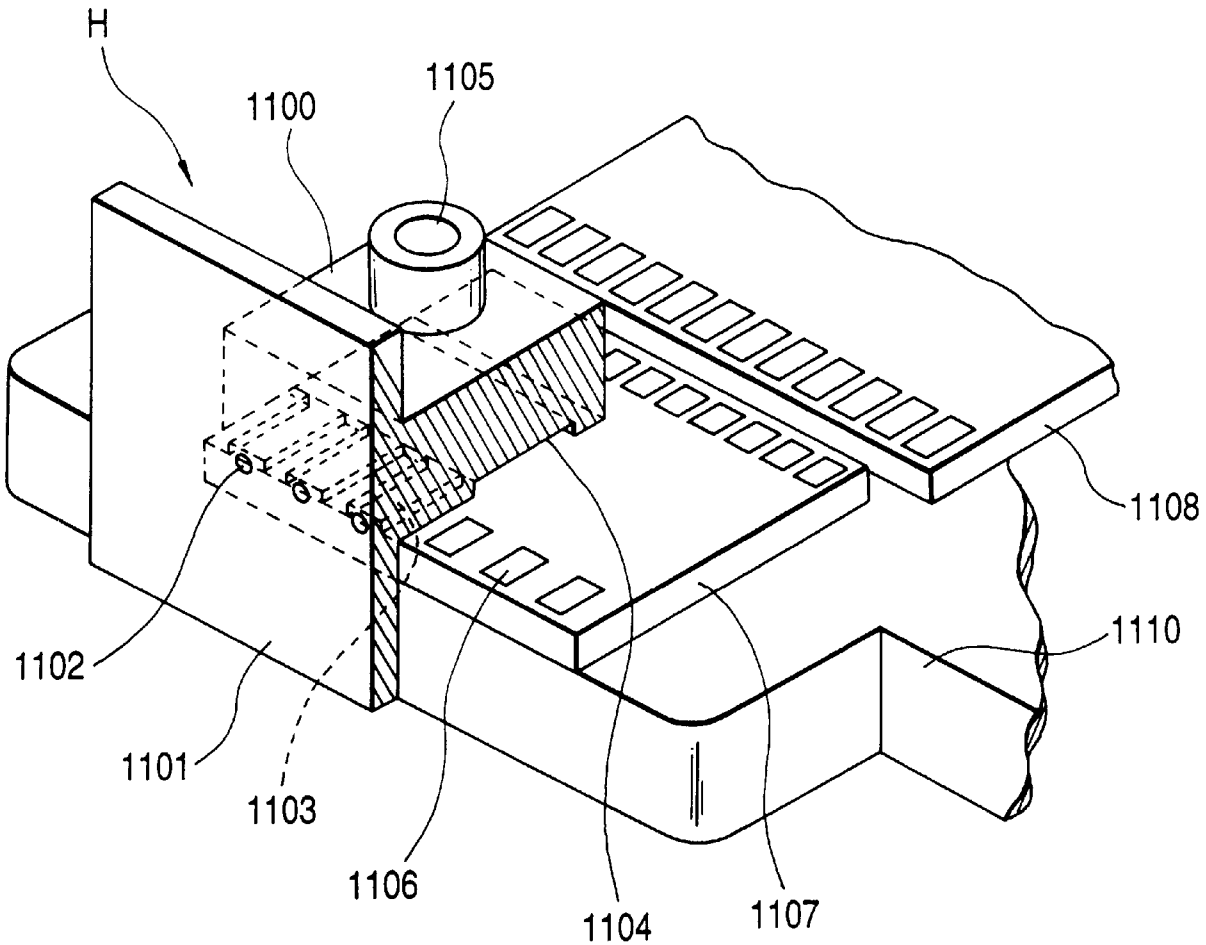
FIG. 33 PRIOR ART
FIG. 33 is a partly broken perspective view which shows the conventional ink jet recording head.
Figure 34:
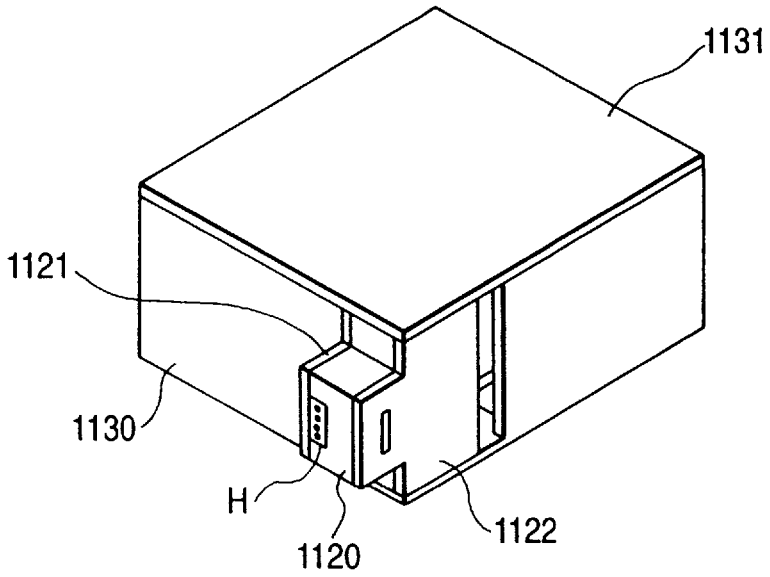
FIG. 34 PRIOR ART
FIG. 34 is a perspective view which shows the conventional ink jet recording cartridge.
Figure 35:
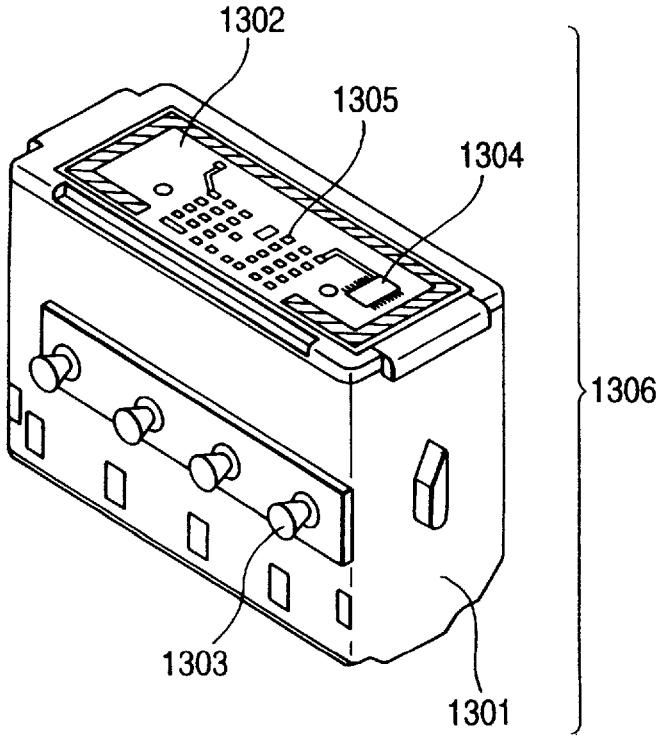
FIG. 35 PRIOR ART
FIG. 35 is a perspective view which shows the assembled body of the conventional ink jet recording head.

For the ink jet recording cartridge 210 of the present embodiment, too, the ink jet recording head 211, which is the same as the one structured in accordance with the conventional art described in conjunction with FIG. 33, is fixed to the predetermined position on the lower face thereof. Also, on the cartridge 210, three ink tanks 212 are installed to contain ink to be supplied to the recording head 211. Here, the ink jet recording cartridge 210 is the so-called one head three-ink type where ink of three colors are supplied to one recording head.

On the back face of the ink jet recording cartridge 210, the flexible board 213 is installed with a plurality of contact pads 213*a* arranged on it. The printing signals are applied to the contact pads from the ink jet recording apparatus main body. One end portion of the flexible board 213 is connected with the ink jet recording head 211. Then, the recording head 211 is driven in accordance with the printing signals, thus discharging ink droplets from the discharge ports 218.

Also, on the side face of the ink jet recording cartridge 210, the first abutting pin 214, the second abutting pin 215, and the third abutting pin (not shown) are arranged. Further, on the bottom face of the ink jet recording cartridge 210, three fourth abutting pins 217, which are formed in the semicircular shape, are arranged. These abutting pins which serve as adjustment means are allowed to abut upon the predetermined positions of the carriage provided for the ink jet recording apparatus. Then, the discharge port surface of the ink jet recording head 211 is aligned exactly with the predetermined position in the carriage.

The contact section of each fourth abutting pin 217 with the positioning unit 253 (see FIGS. 26A and 26B), which will be described later, is formed to be spherical. Then, the ink jet recording head 211 is fixed to the recording cartridge 210 so that all the discharge ports 218 are arranged on one plane parallel to the XY plane with respect to the XY flat surface of each of the fourth abutting pins 217 including its vertex as shown in FIG. 26B. The contact section is almost spherical to each of the positioning units 251, 252, and 253 (see FIGS. 26A and 26B) of the first abutting pin 214, the second abutting pin 215, and the third abutting pin 216, respectively. Then, each contact section is structured to present the point contact with the flat surface of the carriage installation unit provided for the ink jet recording apparatus main body. Therefore, the discharge ports of the recording head 211 are freely rotative on the plane parallel to the XY plane in FIGS. 26A and 26B.

Figure 24:
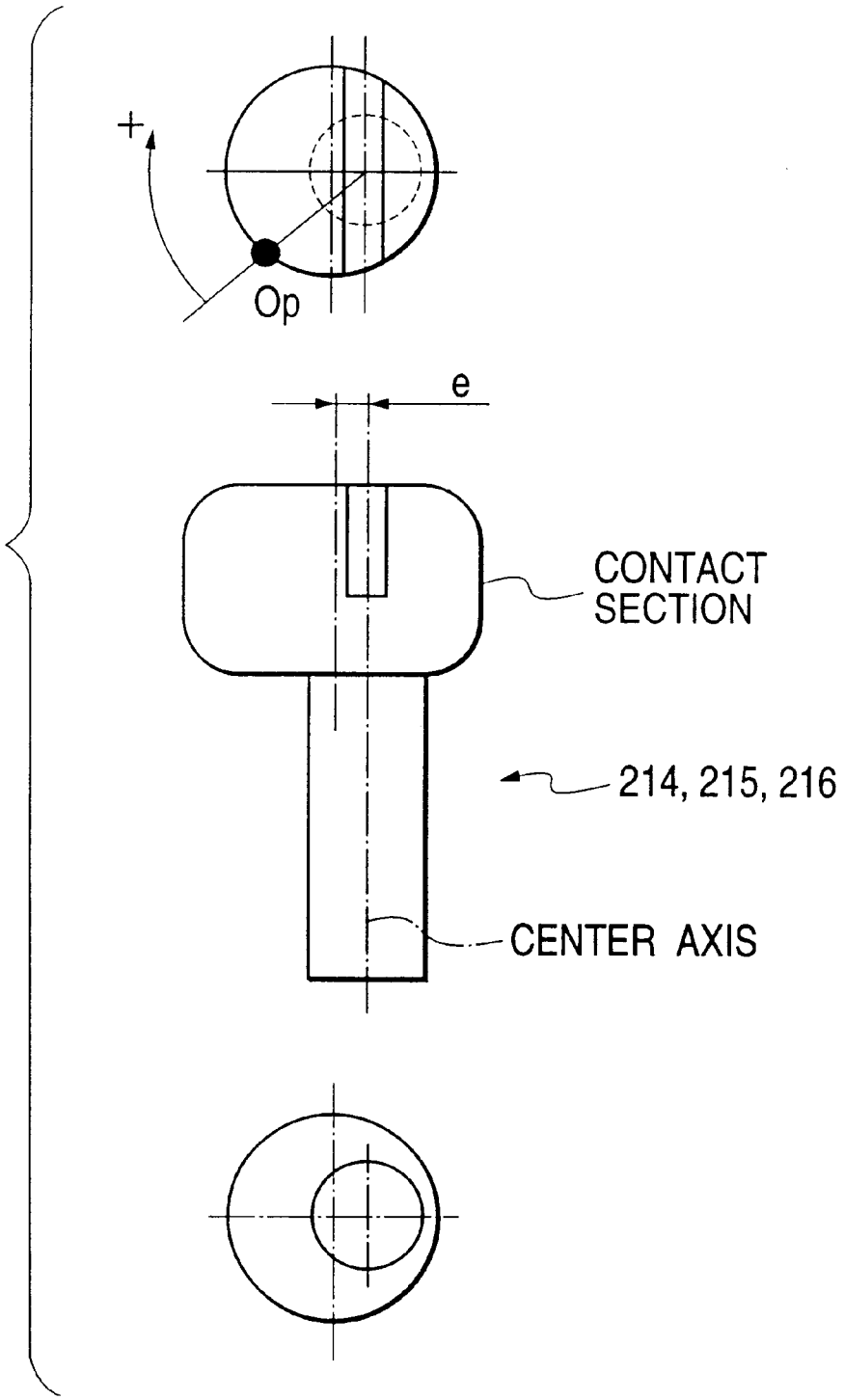
FIG. 24 is a view which illustrates the first to third abutting pins represented in FIG. 23.

FIGS. 24A to 24C are views which illustrate the first to third abutting pins shown in FIG. 23. FIG. 24A is a plan view. FIG. 24B is a side view. FIG. 24C is a bottom view.

Each of the abutting pins 214, 215, and 216 is a part produced separately from the recording cartridge 210 main body, and rotatively pressed into the hole (not shown) for use of the extrusion pin arranged for the recording cartridge 210 main body. Each contact section of these pins is eccentric to the central axis by a predetermined amount e. As a result, each of the extrusion pins is able to change the position of each contact section of the extrusion pin and the position of the discharge ports of the recording head 211 relatively by changing the rotational angle of the extrusion pint with respect to the recording cartridge 210 main body. Also, the arrangement is made so that the discharge ports can be aligned to the predetermined position of the carriage by fixing the rotational angle uniformly. The positive and negative rotational directions of the extrusion pin is regulated with the original point at the reference mark Op in FIG. 24A. Then, its clockwise rotation is defined as positive. In the initial state, the original point Op is fixed to abut upon each of the positioning portions to be described later.

Figure 25B:
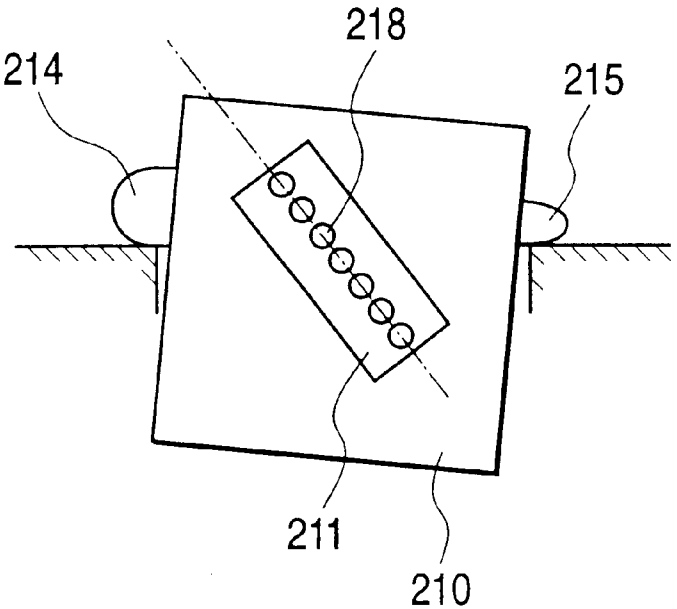
FIGS. 25A and 25B are views which schematically illustrate the arrangement angle of the discharge ports of the ink jet recording cartridge represented in FIG. 23 to the predetermined position of the carriage.
Figure 25A:
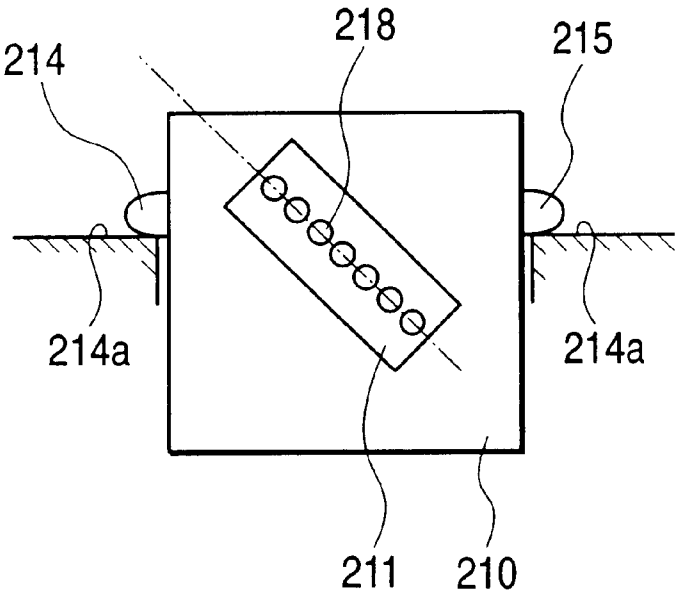

FIGS. 25A and 25B are views which schematically illustrate the arrangement angle of the discharge ports of the ink jet recording cartridge shown in FIG. 23 to the predetermined position of the carriage. FIG. 25A shows the state before the arrangement angle of the discharge ports is modified. FIG. 25B shows the state after the arrangement angle of the discharge ports is modified.

As shown in FIGS. 25A and 25B, the recording cartridge 210 is positioned at an angle to the carriage abutting surface 214*a* which functions as the predetermined position of the carriage by rotating each of the abutting pins 214 and 215 of the recording cartridge 210 with a difference in the rotational amounts to each other. Therefore, even if the recording head 211 is installed on the recording cartridge 210 with errors, it is possible to modify the installation errors of the recording head 211 on the cartridge 210 by mounting the recording cartridge 210 on the carriage with an inclination equivalent to the amount of such errors.

Now, with reference to FIGS. 26A and 26B, the description will be made of the method for manufacturing the ink jet recording cartridge shown in FIG. 23.

Figure 26A:
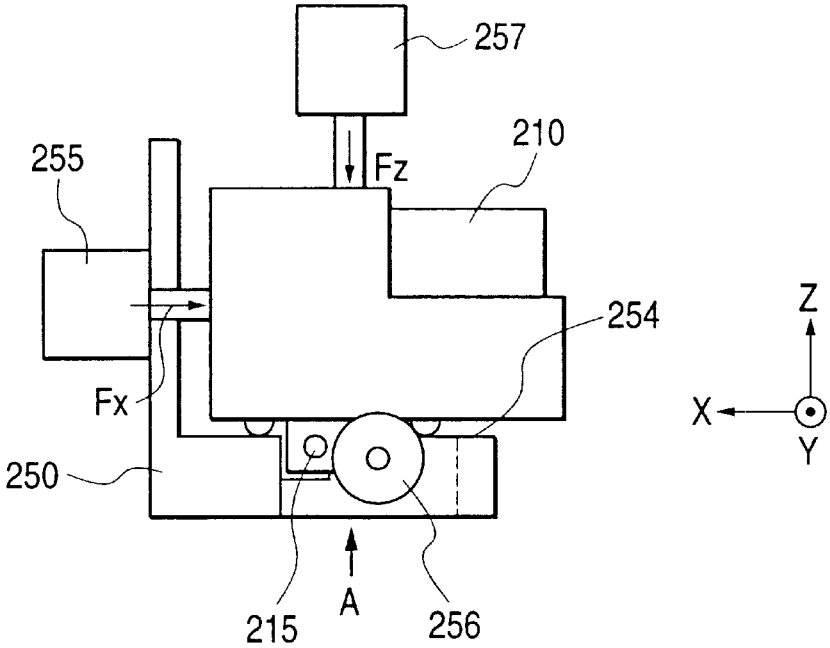
FIGS. 26A and 26B are views which illustrate the state where the ink jet recording cartridge shown in FIG. 23 is mounted on the manufacturing apparatus.
Figure 26B:
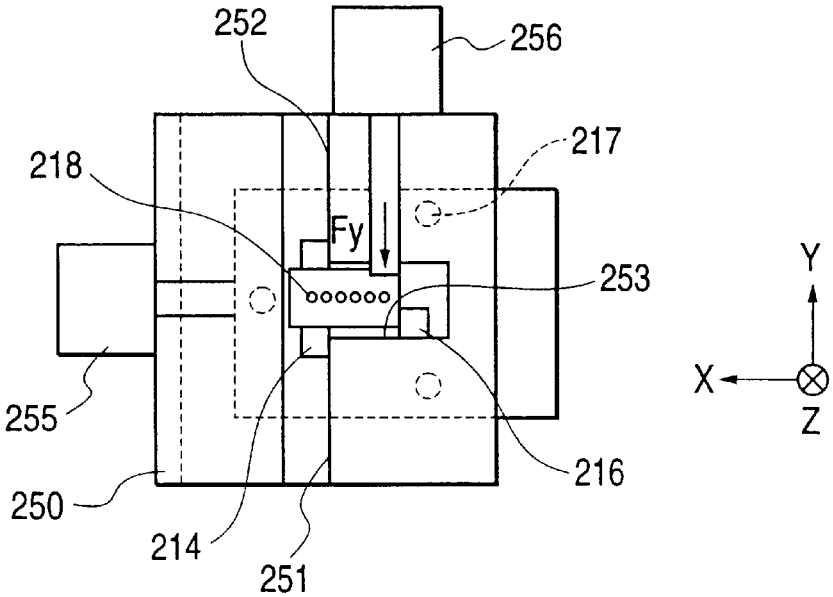

FIGS. 26A and 26B are views which illustrate the state where the ink jet recording cartridge shown in FIG. 23 is mounted on the manufacturing apparatus. FIG. 26A is the side view. FIG. 26B is a view observed in the direction indicated by an arrow A in FIG. 26A.

As shown in FIGS. 26A and 26B, the manufacturing apparatus, which manufactures the ink jet recording cartridge 210 of the present embodiment, comprises the installation frame 250 having each of the positioning units 251, 252, 253, and 254 to mount each of the abutting pins 214, 215, 216, and 217 of the cartridge 210 and position the cartridge 210 in the direction X, Y and Z in FIGS. 26A and 26B; the contact cylinder 255 to press the cartridge 210 in the direction X in FIGS. 26A and 26B; the clamping cylinder 256 to press the cartridge 210 in the direction Y in FIGS. 26A and 26B; and the clamping cylinder 257 to press the cartridge 210 in the direction Z in FIGS. 26A and 26B. The contact cylinder 255, and the clamping cylinders 256 and 257, which serve as fixing means to fix the cartridge 210 in the same condition as it is mounted on the carriage, exert the loads Fx, Fy, and Fz, respectively.

The contact cylinder 255 presses the contact pads 213*a* of the cartridge 210 (see FIG. 23). Each of the clamping cylinders 255 and 256 presses the position corresponding to the position that receives the load from the clutch mechanism (not shown) provided for the ink jet recording apparatus to fix the ink jet recording cartridge 210. Here, since the main body of the ink jet recording cartridge 210 is formed by resin material, such as polypherene sulfide (Noryl manufactured by GE Inc., for example), this body tends to be deformed by the pressurized load from the clutch mechanism serving as means for fixing the cartridge 210. Therefore, the position of the discharge ports 218 is adjusted, while satisfying the clumping conditions in consideration of the anticipated actual loads, the pressurized positions, and the like at the time of mounting the cartridge 210 on the ink jet recording apparatus. Then, it is made possible to offset in advance the influence of such deformation due to the pressurized load.

When the ink jet recording cartridge 210 is fixed on the manufacturing apparatus, the clamping cylinder 256 is driven at first, hence enabling the third abutting pin 216 to abut upon the third positioning unit 253. Then, the contact cylinder 255 is driven to enable the first abutting pin 214 to abut upon the first positioning unit 251, and the second abutting pin 215 upon the second positioning unit 252, respectively. Lastly, the clamping cylinder 257 is driven to press the pressure unit 219 of the cartridge 210 (see FIG. 23). Thus, the ink jet recording cartridge 210 is positioned and fixed on the installation frame 250 of the manufacturing apparatus.

Figure 27:
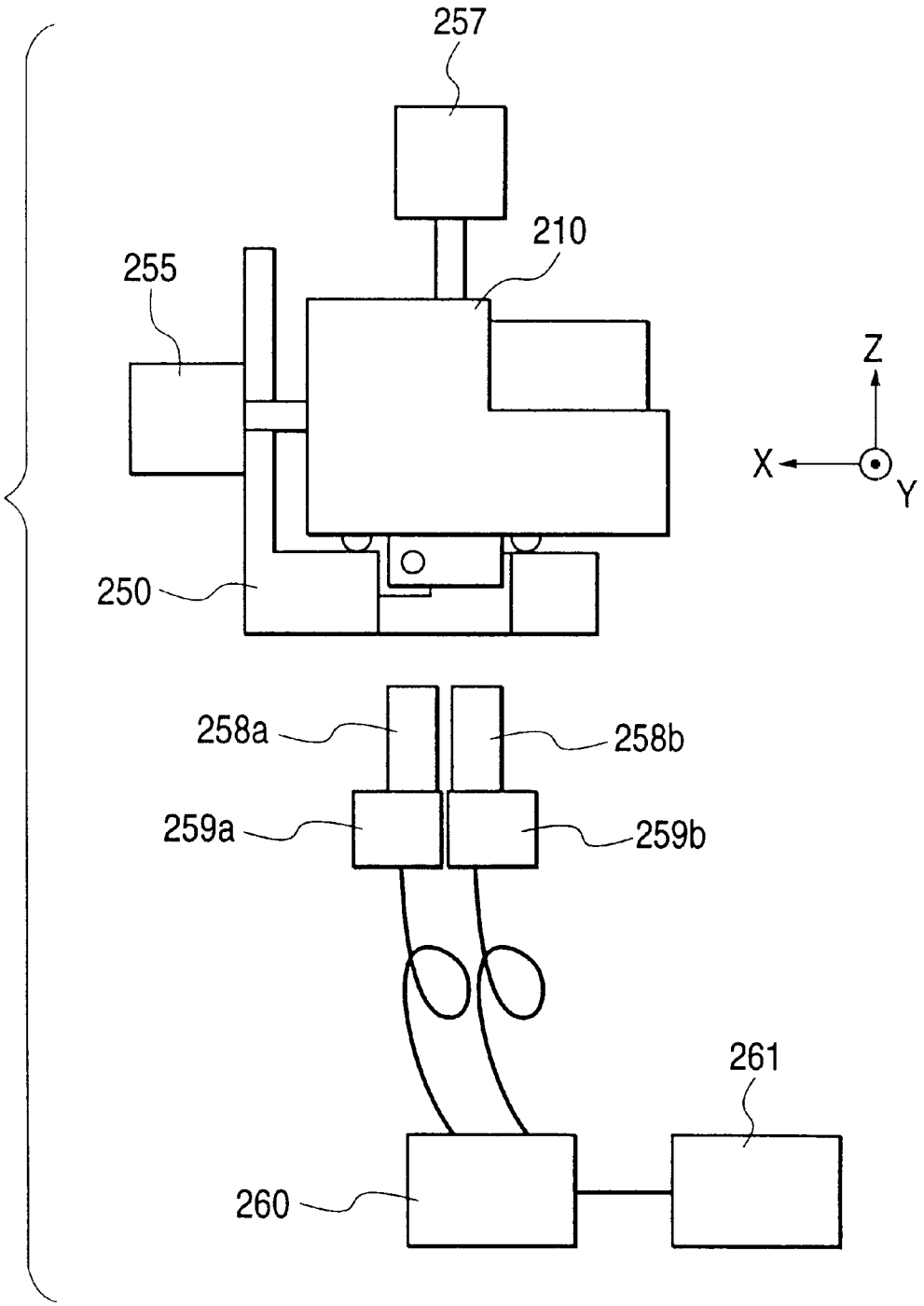
FIG. 27 is a view which shows the imaging system which takes the picture of the discharge portion of the ink jet recording cartridge mounted on the manufacturing apparatus shown in FIGS. 26A and 26B.

FIG. 27 is a view which shows the imaging system that tales the picture of the discharge port unit of the ink jet recording cartridge installed on the manufacturing apparatus shown in FIGS. 26A and 26B.

As shown in FIG. 27, there are provided below the installation frame 250 the macro lenses 258*a* and 258*b*, and the CCD cameras 259*a* and 259*b* as discharge port recognition means for recognizing the position of the discharge ports 218 by imaging the discharge ports 218 of the cartridge 210. Each of the macro lenses and CCD cameras is fixed on the movable stage (not shown) in the direction Z in FIG. 27. Then, it is arranged so that the discharge ports 218 are in focus when the cartridge 210 is fixed to the installation frame 250. For the recording head 211 of the recording cartridge 210, there are arranged 160 discharge ports 218. Then, the macro lenses 258*a*, 258*b*, and the CCD cameras 259*a* and 259*b* are arranged so as to place the first discharge port 218*a* and the 160th discharge port 218*b* within the imaging areas of the CCD cameras 259*a* and 259*b*, respectively.

On the lower face of the installation frame 250, a transparent window portion is arranged to make the discharge ports 218 of the cartridge 210 observable through the window portion. The picture of the discharge ports 218 taken by each of the CCD cameras 259*a* and 259*b* is transferred to the image processing device 260 which is controlled by the controller 261.

Figure 28:
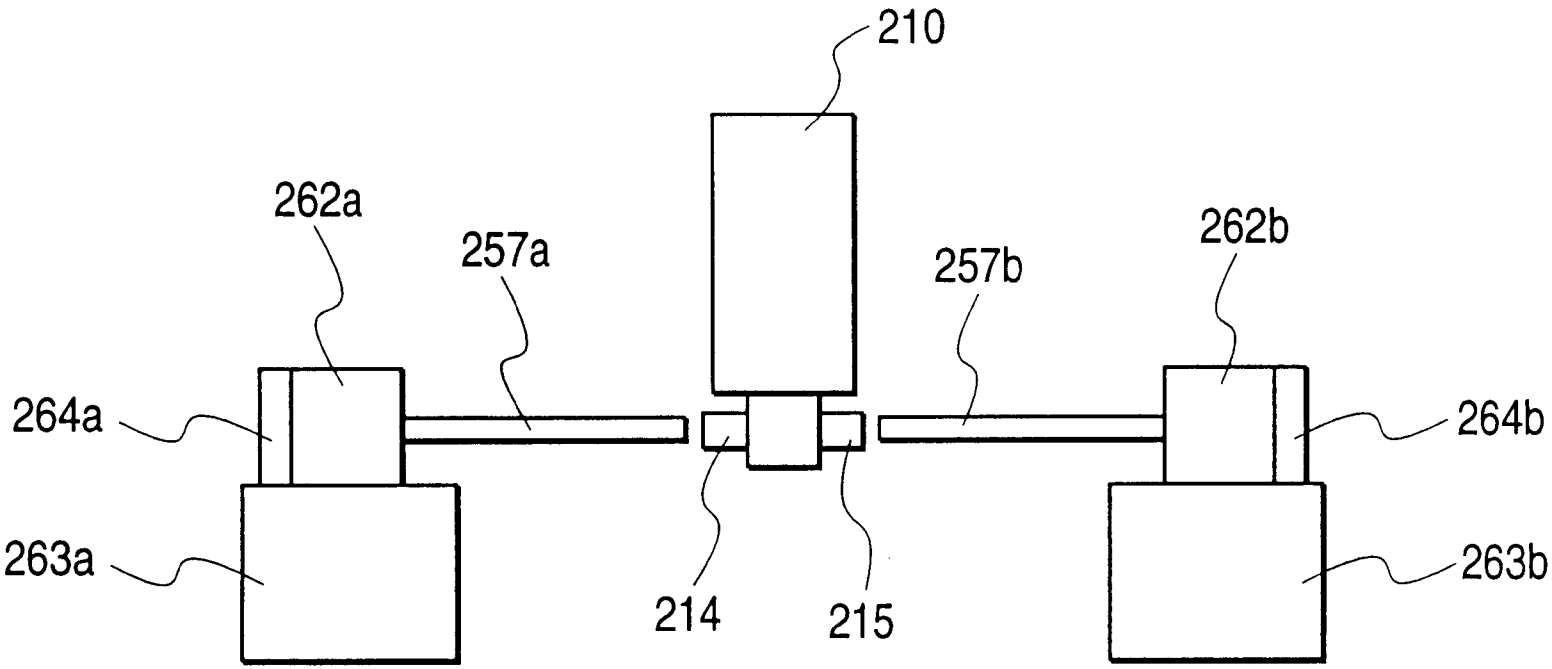
FIG. 28 is a view which shows the adjustment system which adjusts the rotational amount of the abutting pins of the ink jet recording cartridge mounted on the manufacturing apparatus shown in FIGS. 26A and 26B.

FIG. 28 is a view which shows the adjustment system that adjusts the rotational amounts of abutting pins of the ink jet recording cartridge installed on the manufacturing apparatus represented in FIG. 26.

As shown in FIG. 28, the manufacturing apparatus of the present embodiment is provided with the adjustment bitts 257*a* and 257*b* which serve as rotational means for adjusting the rotational amount of each of the abutting pints 214 and 215 of the recording cartridge 210. Each of the adjustment bitts 257*a* and 257*b* is fixed to each leading end of the rotating mechanism 262*a* and 262*b*, respectively. For the rotating mechanisms 262*a* and 262*b*, the rotational angle detectors 264*a* and 264*b* are provided, respectively, and structured to detect the rotational angle of each of the rotating mechanism 262*a* and 262*b* appropriately. Also, each of the rotating mechanism 262*a* and 262*b*, and the rotational angle detectors 264*a* and 264*b* is installed on the translation mechanism 263*a* and 263*b*, respectively.

Figure 29:
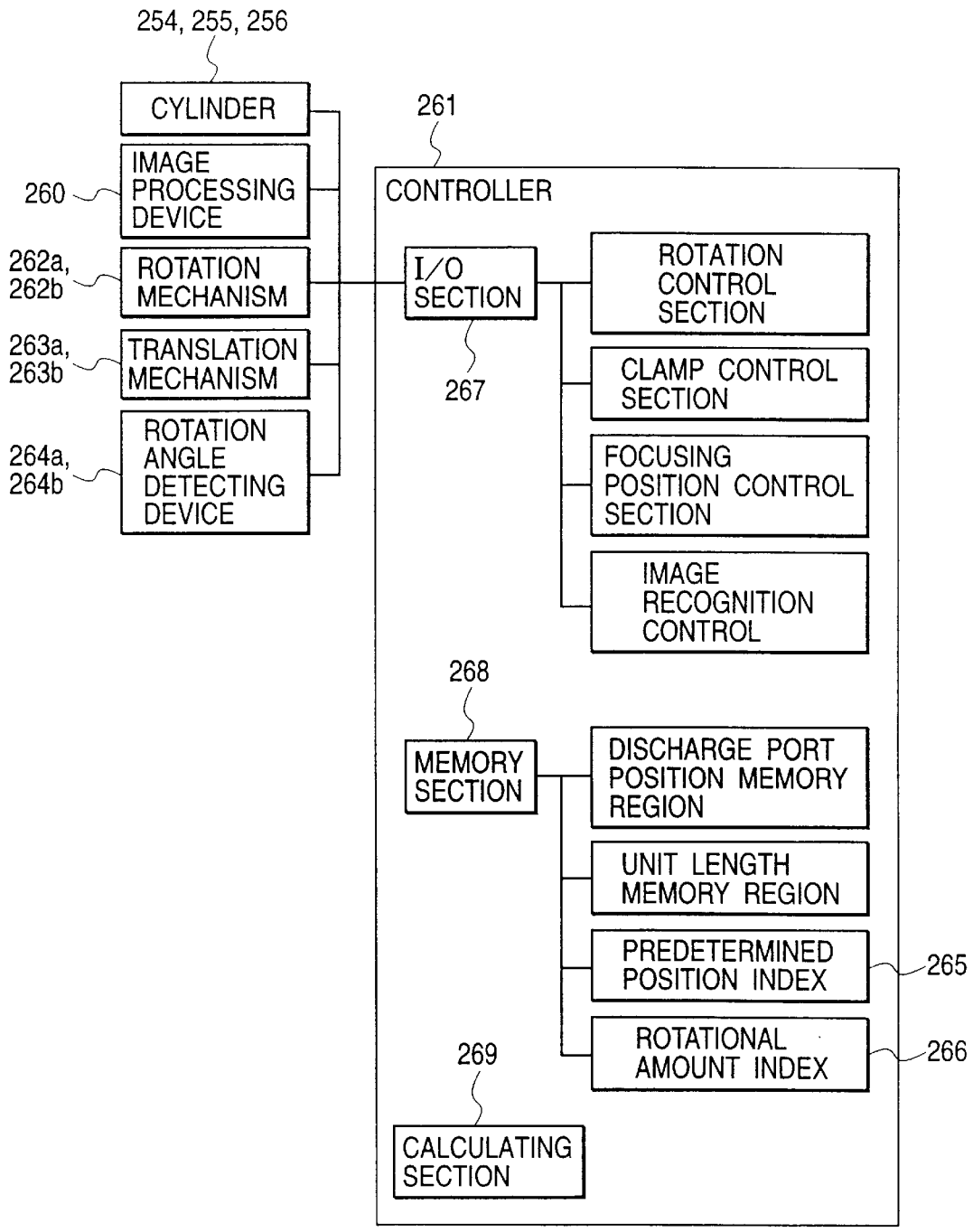
FIG. 29 is a block diagram which shows the controller represented in FIG. 27.

FIG. 29 is a block diagram which shows the controller represented in FIG. 27.

As shown in FIG. 29, the controller 261 comprises the I/O unit 267; the storage 268; and the arithmetic unit 269. The I/O unit 267 is an interface through which signals are transmitted and received between each of the cylinders 255, 256, and 257, the image processing device 260, the rotating mechanisms 262*a* and 262*b*, the translation mechanisms 363*a* and 263*b*, and the rotational angle detectors 264*a* and 264*b*. The storage 268 is formed by the discharge port position storing region; the unit length storing region; the index 265 of the predetermined positions; and the index 266 of the processing amounts. On the discharge port position storing region, the discharge port position coordinates, which are transmitted from the image processing device 260, are stored. On the unit length storing region, the equivalent length per pixel in each imaging area of the CCD cameras 259*a* and 259*b* is stored. By the arithmetic unit 269, each rotational amount of the rotating mechanisms 262*a* and 262*b* is worked out on the basis of the data stored on the storage unit 268.

Figures 30A, 30B:
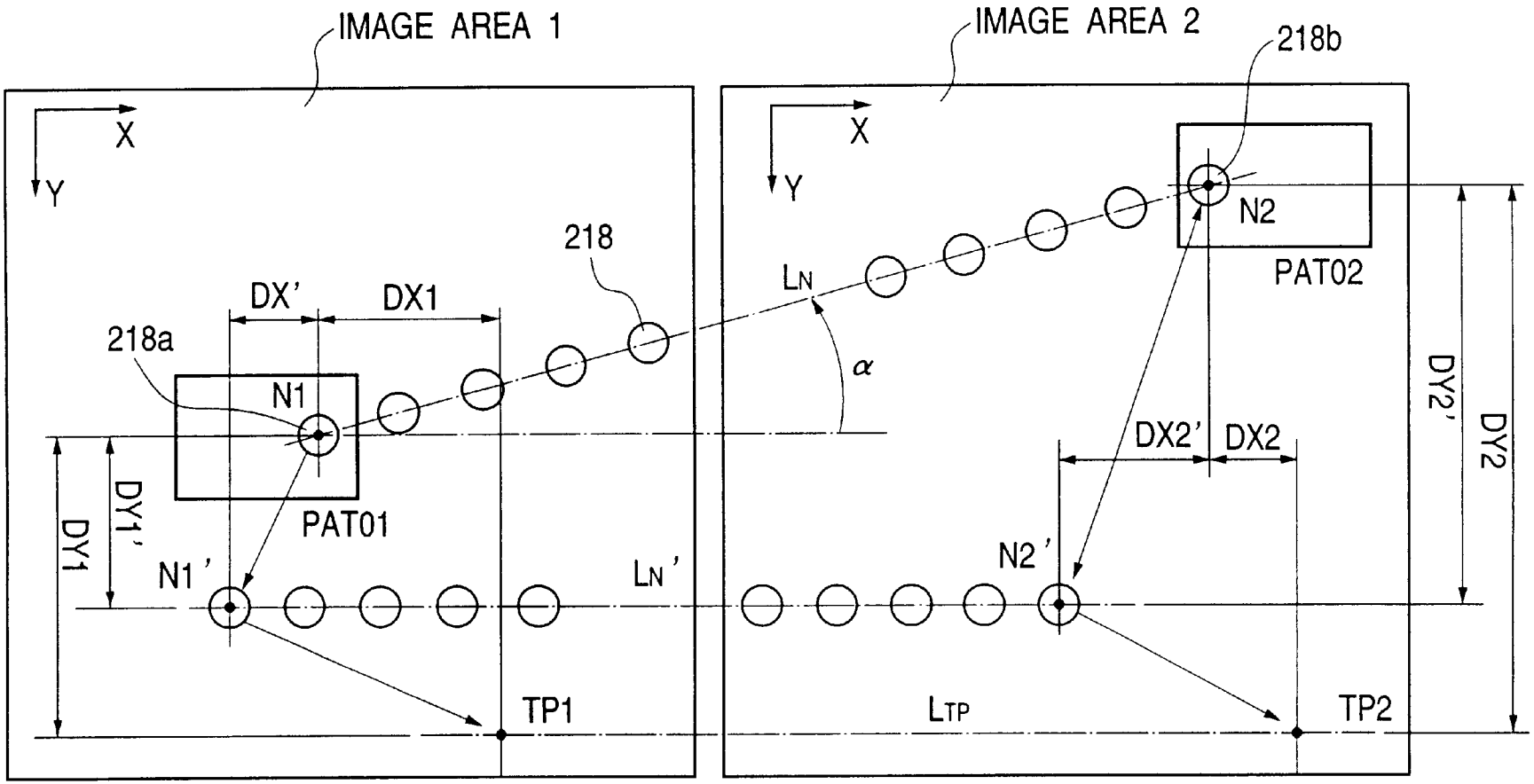
FIGS. 30A and 30B are views which illustrate one example of the picture of the discharge ports taken by the imaging system shown in FIG. 27.

FIGS. 30A and 30B are views which illustrate the example of the discharge port pictures taken by the imaging system shown in FIG. 27. FIG. 30A shows the case where the first discharge port 218*a* is recognized by use of the image pattern called "PAT01" registered on the controller in advance. FIG. 30B shows the case where the 160th discharge port 218*b* is recognized by use of the image pattern called "PAT02" registered on the controller in advance.

Each position of discharge ports is recognized by means of the general pattern matching with several image patterns characteristic of the discharge ports, which are registered on the controller in advance, and used appropriately. The coordinate value N1 of the central position of the first discharge port 218*a*, and the coordinate value N2 of the central position of the 160th discharge port 218*b* are transferred to the controller 261 and stored on it. In this respect, the coordinate value of the central position of each discharge port is represented by the pixel number in the X, Y directions in FIGS. 30A and 30B from the upper left side of each screen.

Now, the description will be made of the method for adjusting the discharge port positions of the ink jet recording cartridge 210 by use of the manufacturing apparatus described above.

At first, the equivalent length is worked out per pixel in the X, Y directions in the imaging area of each of the CCD cameras 259*a* and 259*b*, which is registered on the unit length storing region of the controller 261 as the off-line operation.

Then, the registration is made as to the predetermined positions which are the target positions of the discharge ports to be adjusted. When the predetermined positions are registered, the ink jet recording cartridge (hereinafter referred to as the "master cartridge M"), which has the specific relationship established between each contact section of the abutting pins and the discharge port positions, is fixed at first to the installation frame 250 of the manufacturing apparatus as described above. Then, the discharge port positions of the master cartridge M are recognized by the application of the image recognition method described in conjunction with FIGS. 30A and 30B. After that, the discharge port positions thus recognized are registered on the index 265 of the predetermined positions of the controller 261. Then, all the discharge port positions of the ink jet recording cartridge 210 which should be adjusted are adjusted to the discharge port positions of the master cartridge M.

Subsequently, each shifted amount of the discharge ports in the imaging areas of the CCD cameras, which corresponds to each processing amount of the abutting pins is measured and registered on the index 266 of the rotational amounts.

FIG. 31 is a view which shows one example of the index of the rotational amounts. The θ table indicates the relationship between the arrangement angle α[°] of the discharge ports to be corrected by rotating the first abutting pin 214 and the rotational amount X1[°] of the first abutting pin 214, and the pixel numbers that represent the deviated amounts created by rotating the first abutting pin 214 in the X, Y directions from the original position of the discharge ports. Also, likewise, the translation table indicates each of the rotational amounts X1, X2, and Y[°], and the pixel numbers that represent the deviated amounts created by rotating the first abutting pin 214, the second abutting pin 215, and the third abutting pin 216 in the X, Y directions from the original positions of the discharge ports. In this respect, the values of the translation table are those defined on the assumption that the first abutting pin 214 and the second abutting pin 215 are rotated reversely in the same amount in the positive and negative directions, respectively.

Then, the ink jet recording cartridge 210 which should be adjusted is fixed on the manufacturing apparatus, and the positions of the discharge ports 218 are recognized by means of imaging. The difference between the positions of the discharge ports 218 thus recognized and the target positions registered on the index 265 of the rotational amounts is worked out as described above so as to define each of the rotational amounts of the first abutting pin 214 and the second abutting pin 215 in accordance with the data stored on the index 266 of the rotational amounts.

Here, with reference to FIGS. 30A and 30B again, the description will be made of the method for setting each rotational amount of the abutting pins 214 and 215.

In FIGS. 30A and 30B, the current positions of the first and 160th discharge ports are indicated by the reference marks N1, N2, respectively. Then, the predetermined positions to which each of the discharge ports should be shifted are indicated by the reference marks TP1, TP2, respectively. The adjustment amounts of the first discharge port 218*a* are indicated by the reference marks DX1, DY1, and those of the 160th discharge port 218*b*, by DX2, DY2, respectively. In this respect, the distance between the TP1 and the TP2 and the distance between the N1 and the N2 are the same. Here, the imaginary line LTP that connects the TP1 and the TP2 is assumed to be the X axis.

When each rotational amount is set for the abutting pins 214 and 215, the angle α to the axis X is, at first, worked out for the imaginary line LN that connects the N1 and the N2.

Then, in accordance with the θ adjustment table of the rotational amount index 266 of the θ adjustment table, the rotational amount β1 is worked out for the first abutting pin 214 in order to correct the angle α. If the first abutting pin 214 should be rotated by the rotational amount β1, each of the discharge ports 218 shifts to the imaginary positions N1', N2' so that the aforesaid imaginary line LN becomes the parallel line LN' to the X axis. Now that the first discharge port 218*a* shifts from the position N1 to the N1' in this manner, the distance of shift of the discharge port 218*a* from the position N1' to the position TP1 in the X, Y direction can be expressed as (DX1–DX1'), (DY1–DY1'), provided that each amount of shift in the X, Y directions is defined as DX1', DY1', respectively. Then, the adjustment amount corresponding to the distance in which the discharge port 218*a* should shift from the position N1' to the position TP1 can be obtained from the translation adjustment table of the index of the rotational amounts shown in FIG. 31.

For example, if the angle α is −5°, the DX1 is 55 pixels, and the DY1 is 30 pixels, the rotational amount β1 of the first abutting pin 214 is obtained to be −10° from the θ adjustment table. In this case, the DX1' becomes −5 pixels, and the DY1' becomes +10 pixels. As a result, (the DX1–the DX1') becomes 60 pixels, and (the DY1–the DY1') becomes 20 pixels. Then, from the translation adjustment table, the rotational amount of the first abutting pin 214 is obtained to be −40°, and the rotational amount of the second abutting pin 215, −15°, and the rotational amount of the third abutting pin 216, −15°, respectively.

In accordance with each rotational amount thus obtained, each of the abutting pins is rotated. Here, the rotating method will be described for the first abutting pin 214 as an example.

At first, the translation mechanism 262*a* is operated to enable the adjustment bitt 257*a* to enter the slit (not shown) of the first abutting pin 214. After that, the rotating mechanism 260*a* is operated to allow the adjustment bitt 257*a* to rotate by the rotational amount that has been obtained as described above. With the completion of the rotational adjustment of the first abutting pin 214, the translation mechanism 262*a* is again operated to retract the adjustment bitt 257*a* to the initial position.

The rotational adjustment is made each for the second abutting pin and the third abutting pin in the same manner.

As a result, the first discharge port 218*a* shifts to the position TP1, and the 160th discharge port 218*b* to the position TP2. Then, the discharge ports 218 of the cartridge 210 are aligned for the predetermined position in the carriage easily and exactly.

Figure 32:
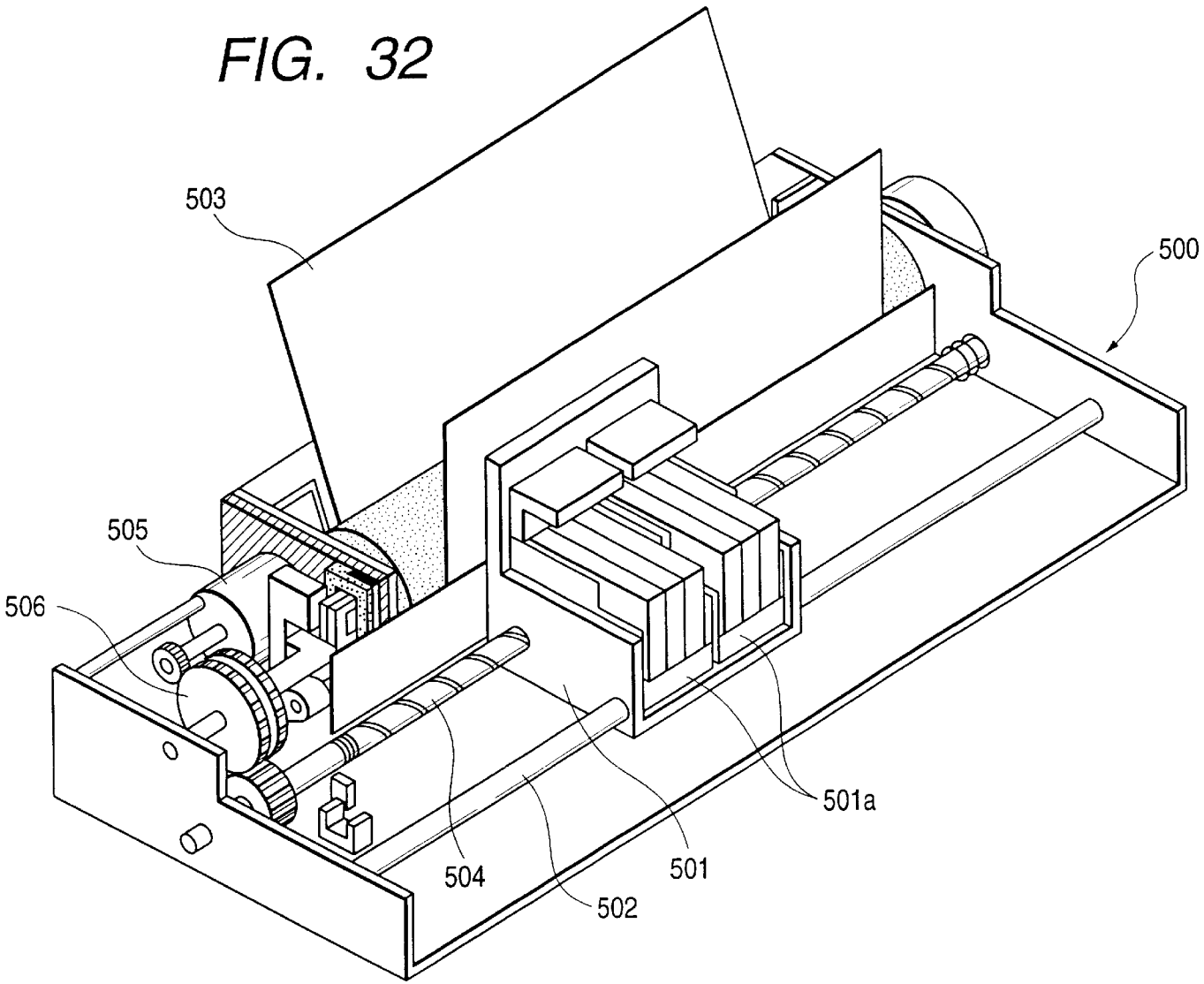
FIG. 32 is a perspective view which shows an ink jet recording apparatus having mounted on it two ink jet recording cartridges of the present invention.

FIG. 32 is a perspective view which shows the ink jet recording apparatus having mounted on it the two ink jet recording cartridges of the present invention described above.

Each of the ink jet recording cartridge 501*a* abuts upon the carriage 501, which is fixed to it by means of a latching mechanism (not shown). The structure is arranged so that when the driving motor 505 is driven to rotate the shaft 504 thorough the gear trains 506, the carriage 501 reciprocates along the shaft 502 in the longitudinal direction of the shaft 502. Also, the recording medium 503 is carried by means of a carrier device (not shown) to carry the recording medium.

The recording apparatus 500 is provided with the controlling unit (not shown) which serves as means for supplying driving signals which are supplied to the ink jet recording head for discharging ink from the discharge ports. Ink droplets discharged from the discharge ports of each of the cartridges arrive at the recording medium 503 to adhere to it for the formation of imaged on the recording medium 503.

What is claimed is:

1. An ink jet recording cartridge to be mounted on a movable carriage, comprising:

an ink jet recording head for recording by discharging ink from a discharge port to a recording medium; and a housing for holding said ink jet recording head, said housing being provided with an extrusion structured as a cam member rotatively fixed to said housing and arranged to abut upon a grooved portion of the carriage, said extrusion being capable of adjusting relative positions of said ink jet recording cartridge and the carriage.

2. An ink jet recording cartridge according to claim 1, wherein portions of said extrusion abutting upon said grooved portion are structured so as to be retractable in a direction opposite to an abutting direction of said ink jet recording cartridge toward the carriage.

3. An ink jet recording cartridge according to claim 1, wherein said extrusion is provided integrally with said housing.

4. An ink jet recording cartridge according to claim 1, wherein said extrusion is formed by resin material.

5. An ink jet recording cartridge according to claim 1, wherein said extrusion is provided for a side face of said housing substantially perpendicular to a direction of reciprocal traveling of the carriage.

6. An ink jet recording cartridge according to claim 5, wherein said housing is further provided with additional such extrusions and with another side face substantially perpendicular to the direction of reciprocal traveling of the carriage, and on one of said two side faces, one of said extrusions is arranged, and on said other side face, two of said extrusions are arranged.

7. An ink jet recording cartridge according to claim 1, wherein said housing is further provided with ridge portions, one of the ridge portions abutting upon the carriage when the cartridge is mounted on the carriage being formed to be spherical.

8. An ink jet recording cartridge according to claim 1, wherein said housing is further provided with a contact surface having contact pads to be connected with contact points provided on the carriage, and on each end of said housing below said contact surface a substantially triangular extrusion is arranged.

9. An ink jet recording cartridge according to claim 8, wherein a rib type extrusion is further arranged on a portion of said housing between said substantially triangular extrusions.

10. An ink jet recording cartridge according to claim 8, wherein above said contact surface on the surface of said housing having said contact surface, another extrusion is provided for exerting pressure on said housing to press said housing to the carriage.

11. An ink jet recording cartridge according to claim 1, wherein the carriage is provided with a push-out member to push said ink jet recording cartridge out of the carriage by pressing said ink jet recording cartridge when removing said ink jet recording cartridge mounted on the carriage, and on a portion of said housing pressed by said push-out member, an inclined surface is formed for said push-out member to slide thereon.

12. An ink jet recording cartridge according to claim 1, wherein in order to arrange said discharge port for a predetermined position in the carriage, portions of said extrusion abutting against said grooved portion are retracted by a specific distance in a direction opposite to an abutting direction of said ink jet recording cartridge toward the carriage.

13. An ink jet recording cartridge to be mounted on a movable carriage, comprising:

an ink jet recording head for recording by discharging ink from a discharge port to a recording medium; and a housing for holding said ink jet recording head, wherein said housing is provided with an adjusting means abutting upon the carriage for arranging the discharge port of said ink jet recording cartridge for a predetermined position in the carriage when said ink jet recording cartridge is mounted on the carriage, said adjusting means being movable relative to said housing so as to adjust relative positions of said ink jet recording cartridge and the carriage.

14. An ink jet recording cartridge according to claim 13, wherein said adjusting means is rotatively fixed to said housing, and a portion of said adjusting means which contacts the carriage comprises an abutting pin eccentric to a rotational axis of said adjusting means.

15. An ink jet recording cartridge according to claim 1 or claim 13, wherein said ink jet recording head is provided with electrothermal transducing members for generating thermal energy for discharging ink.

16. An ink jet recording cartridge according to claim 15, wherein said ink jet recording head discharges ink from said discharge port by film boiling created in ink by thermal energy applied by said electrothermal transducing members.

17. A recording apparatus comprising:

an ink jet recording cartridge according to claim 1 or claim 13; and means for supplying driving signals to supply the driving signals for discharging ink from said ink jet recording head.

18. A recording apparatus according to claim 17, wherein said recording apparatus performs recording by discharging ink from said ink jet recording head to adhere ink to a recording medium.

19. A recording apparatus comprising:

an ink jet recording cartridge according to claim 1 or claim 13; and recording medium carrying means to carry a recording medium for receiving ink discharged from said ink jet recording head.

20. A recording apparatus according to claim 19, wherein said recording apparatus performs recording by discharging ink from said ink jet recording head to adhere ink to a recording medium.

* * * * *